US006165704A

United States Patent [19]

Miyake et al.

[11] Patent Number: 6,165,704

[45] Date of Patent: Dec. 26, 2000

[54] SILVER HALIDE PHOTOGRAPHIC LIGHT-SENSITIVE MATERIAL

[75] Inventors: Kiyoteru Miyake; Tadashi Ikeda, both of Minami-ashigara, Japan

[73] Assignee: Fuji Photo Film Co., Ltd., Minami-ashigara, Japan

[21] Appl. No.: 09/396,463

[22] Filed: Sep. 15, 1999

[30] Foreign Application Priority Data

Sep. 16, 1998 [JP] Japan ..... 10-280598

[51] Int. Cl.[7] ..... G03C 1/09; G03C 1/34

[52] U.S. Cl. ..... 430/600; 430/405; 430/448; 430/566; 430/604; 430/608; 430/613

[58] Field of Search ..... 430/550, 551, 430/600, 604, 608, 613

[56] References Cited

U.S. PATENT DOCUMENTS 5,194,362 3/1993 Nakabayashi et al. ..... 430/203
5,223,384 6/1993 Ohbayashi et al. ..... 430/203
5,908,736 6/1999 Yamazaki ..... 430/203
6,001,543 12/1999 Asami et al. ..... 430/551

FOREIGN PATENT DOCUMENTS 8-54705 2/1996 Japan .
8-54724 2/1996 Japan .

*Primary Examiner*—Hoa Van Le
*Attorney, Agent, or Firm*—Burns, Doane, Swecker & Mathis, LLP

[57] ABSTRACT

There is disclosed a silver halide photographic light-sensitive material which contains, on a support, a specific nitrogen-containing heterocyclic compound, and a divalent metal cation that is an acid with intermediate hardness/softness classified in accordance with the HSAB principle, in an amount 1 to 300 times the number of moles of the nitrogen-containing heterocyclic compound. The light-sensitive material can form an image with high sensitivity and low fogging, both in heat-development processing characterized by its ease and rapidness, and in usual liquid-developing processing that is widely used.

12 Claims, No Drawings

SILVER HALIDE PHOTOGRAPHIC LIGHT-SENSITIVE MATERIAL

FIELD OF THE INVENTION

The present invention relates to a silver halide photographic light-sensitive material for photography. More specifically, the present invention relates to a light-sensitive material that can form an image with high sensitivity and low fogging easily and rapidly, both in heat-development processing and in liquid development processing that uses a bath containing a developing agent.

BACKGROUND OF THE INVENTION

Hitherto, a photographic process in which silver halides are used has been most widely used as it is excellent in photographic characteristics, such as sensitivity, gradation adjustment, resolving power, and the like, in comparison with other methods, such as electrophotography or diazo photography. The process is still being developed further, and currently it is possible to easily obtain a black-and-white image or color image with high image quality.

However, there is an increasingly strong demand for a process to obtain a photographed image more simply and rapidly, with a low environmental load. To attempt easier processing, a heat-developable color light-sensitive material for photographing containing therein a developing agent, is disclosed in JP-A-9-274295 ("JP-A" means unexamined published Japanese patent application). In heat-developing system, in general, though an image can be rapidly formed, fogging occurs readily, and attainment of good discrimination is not easy. JP-A-10-90848 discloses that, with respect to fog in a heat-developable light-sensitive material, not only emulsion fog but also development fog (heat fog) due to high-temperature processing contributes largely, and that, in order to restrain the heat fog and to achieve both high sensitivity and good discrimination of images, a specific antifogging agent is useful.

In fact that the above-mentioned antifogging agent, when used in heat-development, performs a maximum discrimination effect; however, when used in color-development process employing a currently available developing agent of paraphenylenediamine, there is a problem that it has strong desensitization effects, causing low sensitivity and/or low density. Therefore, such a light-sensitive material is unfit as a heat-developable light-sensitive material for photographing.

If a light-sensitive material for heat-development has compatibility with a conventional processing used in a widely-prevailing, small-sized, and simple printer processor, the so-called "mini-lab", installed in laboratories for color photography or stores, it can make conventional processing possible, as well as rapid processing, not requiring special additional equipment, to allow anyone to easily enjoy color photography. Such a heat-developable light-sensitive material that can be also used in conventional color-developing processing has long been desired.

SUMMARY OF THE INVENTION

A primary object of the present invention is to provide a light-sensitive material having characteristics of high sensitivity and low fogging, which can be used both in heat-development processing characterized by its ease and rapidness, and in conventional liquid-developing processing that is widely used.

Other and further objects, features, and advantages of the invention will appear more fully from the following description.

DETAILED DESCRIPTION OF THE INVENTION

The object of the present invention can be attained by a light-sensitive material described in the following items (1) to (6).

(1) A silver halide photographic light-sensitive material, which contains, on a support, at least one nitrogen-containing heterocyclic compounds represented by one of general formula (1), (2), (3), (4) or (5), and contains a divalent metal cation that is an acid with intermediate hardness/softness classified in accordance with the HSAB principle, in an amount 1 to 300 times the number of moles of the nitrogen-containing heterocyclic compound:

General formula (1)

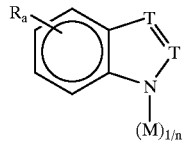

General formula (2)

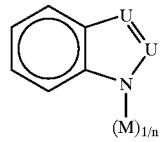

General formula (3)

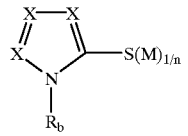

General formula (4)

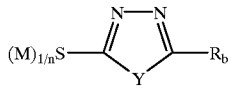

General formula (5)

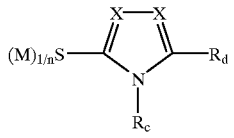

wherein $R_a$, $R_b$, $R_c$, and $R_d$ each independently represent an alkyl group, a cycloalkyl group, an alkenyl group, an alkynyl group, an aralkyl group, an aryl group, a heterocyclic group, an alkoxy group, an aryloxy group, an amino group, an acylamino group, a ureido group, a urethane group, a sulfonamide group, a sulfamoyl group, a carbamoyl group, a sulfonyl group, an oxycarbonyl group, an acyl group, an acyloxy group, an alkylthio group or an arylthio group, in which the number of carbon atoms of the $R_a$ is 4 or more but 16 or less, the total number of carbon atoms of the $R_b$ is 10 or more, and the sum of carbon atoms of $R_c$ and $R_d$ is 12 or more; each of T represent a nitrogen atom, C—H or C—SH; each of U represent a nitrogen atom, C—H, C—SH or C—$R_a$, and at least one of them is C—$R_a$; each of X represent a nitrogen atom or C—H; Y represents an oxygen atom, a sulfur atom, or N—H;

M, if it is univalent, represents a hydrogen atom, an alkali metal atom, a quaternary ammonium group, or a quaternary phosphonium group, with n being 1; M, if it is divalent, represents an alkaline earth metal atom, a cadmium, or an atom being a divalent metal cation having intermediate hardness/softness in accordance with the HSAB principle, with n being 2; M, if it is trivalent, represents a boron, an aluminum, or an iron, with n being 3; in general formulae (1) and (2), the benzene ring may have a substituent.

(2) The silver halide photographic light-sensitive material described in the above item (1), which has, on a support, a photosensitive layer comprising a silver halide emulsion that contains tabular silver halide grains with a thickness of 0.2 μm or less.

(3) The silver halide photographic light-sensitive material described in the above item (1) or (2), wherein it comprises, on a support, a photosensitive layer comprising a silver halide emulsion that contains silver halide in which silver chloride content is 50 mol % or more.

(4) The silver halide photographic light-sensitive material described in the above items (1), (2), or (3), wherein the divalent metal cation is a zinc ion, a copper ion, a nickel ion, or a lead ion.

(5) The silver halide photographic light-sensitive material described in any one of the above items (1) to (4), wherein it contains a developing agent represented by any one of general formulae (6) to (9).

General formula (6)

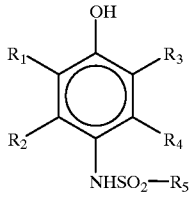

General formula (7)

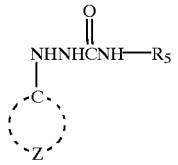

General formula (8)

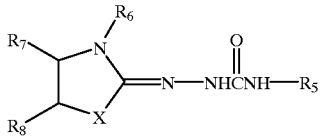

General formula (9)

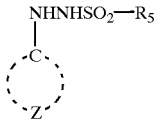

wherein $R_1$, $R_2$, $R_3$, and $R_4$ each independently represent a hydrogen atom, a halogen atom, an alkyl group, a cycloalkyl group, an aryl group, an alkylcarbonamide group, an arylcarbonamide group, an alkylsulfonamide group, an arylsulfonamide group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, or an acyloxy group; $R_5$ represents an alkyl group, an aryl group, or a heterocyclic group; Z represents a group of atoms forming a (hetero)aromatic ring, if Z is a benzene ring, the sum of Hammett's constant (σ) of its substituents is 1 or more; $R_6$ represents an alkyl group; X represents an oxygen atom, a sulfur atom, a selenium atom, or an alkyl- or aryl-substituted tertiary nitrogen atom; $R_7$ and $R_8$ each represent a hydrogen atom or a substituent, or $R_7$ and $R_8$ may bond together to form a double bond or a ring; further, at least one ballasting group having 8 or more carbon atoms is contained in each of general formulae (6) to (9), in order to impart oil-solubility to the molecule.

(6) The silver halide photographic light-sensitive material described in any one of the above items (1) to (5), wherein an image can be formed by:

- a development by heat, wherein water, whose amount corresponds to 1/10 to 1-fold times the volume of water required for the maximum swelling of an entire coated film of the light-sensitive material, is made to lie between the light-sensitive material and a processing material that includes a base and/or a base precursor, and these materials are processed with overlapping each other, or
- a development using a processing bath containing a developing agent that is an aromatic primary amine.

The divalent metal cation used in the present invention, which is an acid having intermediate hardness/softness in accordance with HSAB principle, is hereinafter described.

As the acid used in the present invention is classified to the intermediate portion on a scale according to HSAB principle, it can be said it has intermediate hardness or intermediate softness.

The HSAB principle (Principle of Hard and Soft Acids and Bases) is a principle proposed by R. G. Pearson to classify the strength of acids and bases in view of "hardness" or "softness". A hard acid has strong affinity to a hard base, while a soft acid has strong affinity to a soft base.

A "hard acid" is an acid having a small atom that acts as an electron acceptor, having no valence electron entered into an orbit that is easily deformed, and having a high positive charge. A "soft acid" is an acid having a large atom that acts as an electron acceptor, having valence electrons entered in an orbit that is easily deformed, and carrying no or little electrical charge.

A "hard base" is one in which a valence electron binds strongly to an atom. A "soft base" is one in which a valence electron is readily polarized.

The HSAB principle and classification of acids and bases based on the principle are described in Section 15 of Chapter 9 in "Inorganic Chemistry—A Guide to Advanced Study" by R. B. Heslop and K. Jones.

Examples of the divalent metal cation being an acid having intermediate hardness/softness in accordance with the HSAB principle include an iron ion, a copper ion, a zinc ion, a nickel ion, a lead ion, a cobalt ion and a tin ion, with preference given to an iron ion, a zinc ion, a nickel ion, a lead ion, and cobalt ion. Two or more kind of ions out of them may be used at the same time. Particularly, the zinc ion, nickel ion, and lead ion are preferably used. A zinc ion is especially preferable.

The divalent metal cation, being an acid having intermediate hardness/softness according to the HSAB principle, reacts with a nitrogen-containing heterocyclic compound, to stably form a complex thereof, and it is presumed that this reaction serves to achieve an effect of the present invention.

Examples of anions acting as a counter ion include a nitrate ion, a sulfate ion, a chloride ion, a bromide ion, an iodide ion, a carbonate ion, a sulfite ion, a bicarbonate ion, a bisulfite ion, an ammonium ion, an acetate ion, a phosphate ion or the like. Preferably, a nitrate ion, a sulfate acid ion, a chloride ion, a bromide ion, and an acetate ion are used, because they have less photographic effects. The nitrate ion is particularly preferably used.

A water-soluble compound is preferably used as a compound containing divalent ions for use in the present invention. For example, zinc nitrate hexahydrate, nickel nitrate, copper sulfate hexahydrate, zinc sulfate, lead acetate trihydrate, ferrous sulfate, cobaltous nitrate are used.

The divalent metal cation used in the present invention can be added to any of a silver halide emulsion layer, an intermediate layer, a protective layer, a subbing layer, and an antihalation layer; and, it is preferable to add the metal cation to a layer to which a nitrogen-containing heterocyclic compound, described later, is added.

As to timing of their addition, these divalent metal cations may be added either before or after the addition of the nitrogen-containing heterocyclic compound.

According to the present invention, the time interval between the addition of the divalent metal cation and the nitrogen-containing heterocyclic compound is preferably 90 minutes or less, more preferably 45 minutes or less, and further preferably 20 minutes or less.

Preferably, these compounds are added in the presence of gelatin or other water-soluble binders.

If the nitrogen-containing heterocyclic compound is added to oil in a gelatin dispersion of a coupler, the divalent metal cation may be added to the gelatin.

A gelatin dispersion prepared by adding the nitrogen-containing heterocyclic compound to a gelatin solution containing the divalent metal cation may be used as well.

The addition amount of the divalent metal cation to a light-sensitive material is preferably 1 to 300 times, in terms of moles, the sum of total amount of the below-mentioned nitrogen-containing heterocyclic compound for each layer, more preferably 1.5 to 200 times, and particularly preferably 2 to 100 times.

The divalent metal cation reacted with the nitrogen-containing heterocyclic compound to form a complex is not deemed to be a component of heterocyclic compound and is considered to be an "added" cation, in the present invention.

The amount of the divalent metal cation per mol of silver is preferably $3\times10^{-3}$ to 1 mol, more preferably $5\times10^{-3}$ to $5\times10^{-1}$ mol, and further preferably $10^{-2}$ to $10^{-1}$ mol.

Since viscosity increases due to the reaction between the divalent metal cation and the gelatin, the amount of the divalent metal cation to be added is preferably 30% or less of the total amount of the gelatin in the added layer, and more preferably 20% or less, by weight.

If excessive divalent metal cations exist concomitantly with the nitrogen-containing heterocyclic compound, various complexes, each having a large mole ratio of a divalent metal salt or a divalent metal ion, are produced. However, the complex would not become coarse to cause precipitation, and it is suspended almost uniformly, under the presence of the gelatin and/or the binder.

Also, in the present invention, the divalent metal cation exists in excess, compared with the divalent metal salt of formulae (1) to (5), and thus the metal salt is stabilized. If a divalent metal ion exists only as a divalent metal salt of a nitrogen-containing heterocyclic compound, as described in U.S. Pat. No. 3,649,267, JP-A-62-291642, JP-A-8-54705, and JP-A-8-54724, the metal salt is unstable, and therefore the nitrogen-containing heterocyclic compound is liberated, to be adsorbed to silver halide particles, resulting in great desensitization in usual color-developing treatment. Therefore, such addition does not exhibit the effect desired in the present invention.

Because of the presence of excessive amounts of the divalent metal cations, the divalent metal salt produced in accordance with the present invention is not sparingly soluble, differing from those disclosed in JP-A-8-54705 and JP-A-8-54724.

JP-A-10-161263 and JP-A-10-161262 describe that a zinc ion, if added to a gelatin dispersion of an emulsion when a metal cyanic complex is doped in a silver halide, serves to suppress the inhibition of gold sensitization, and is preferable in view of attaining high sensitivity. However, in these publications, the amount of zinc to be added is 0.5 mole or less per mole of the nitrogen-containing heterocyclic compound. This range of the amount of zinc is different from that of the present invention, and it cannot give the effect expected in the present invention.

Next, the nitrogen-containing heterocyclic compound used in the present invention is described below.

The compounds represented by general formulae (1) and (2) are a benzimidazole compound, a benzopyrazole compound, a benzotriazole compound, or the like. The compound may have a mercapto group. In general formulae (1) and (2), the benzene ring may have a substituent.

Each of T represents a nitrogen atom, C—H or C—SH. Each of U represents a nitrogen atom, C—H, C—SH, or C—$R_a$, and at least one of them is C—$R_a$.

$R_a$ is a substituted or unsubstituted group, having carbon atoms of 4 to 16, that includes an alkyl group (e.g., n-butyl, t-butyl, n-octyl, dodecyl and hexadecyl), a cycloalkyl group (e.g., cyclopentyl and cyclohexyl), an alkenyl group (e.g., 2-butenyl and 3-pentenyl), an alkynyl group (e.g., 3-pentynyl), an aralkyl group (e.g., benzyl and phenethyl), an aryl group (e.g., phenyl, naphthyl and 4-methylphenyl), a heterocyclic group (e.g., pyridyl, furyl, imidazolyl, piperidinyl and morpholyl), an alkoxy group (e.g., methoxy, ethoxy, butoxy, 2-ethylhexyloxy, ethoxyethoxy, methoxyethoxy and dodecyloxy), an aryloxy group (e.g., phenoxy and 2-naphthyloxy), an amino group (e.g., diethylamino, dipropylamino, dibutylamino, butylamino, dibenzylamino and anilino), an acylamino group (e.g., benzoylamino, octanoylamino, 2-ethylhexanoylamino and dodecanoylamino), a ureido group (e.g., N-butylureido, N-phenylureido, hexylureido, octylureido and dodecylureido), a thioureido group (e.g., N-butylthioureido, N-phenylthioureido and octylthioureido), a urethane group (e.g., butoxycarbonylamino, phenoxycarbonylamino and hexyloxycarbonylamino), a sulfonamido group (e.g., butanesulfonamido, benzenesulfonamido and octanesulfonamido), a sulfamoyl group (e.g., N,N-propylsulfamoyl, N-phenylsulfamoyl and dibutylsulfamoyl), a carbamoyl group (e.g., N,N-dipropylcarbamoyl, N-phenylcarbamoyl, octylcarbamoyl, and dodecylcarbamoyl), a sulfonyl group (e.g., tosyl), a sulfinyl group (e.g., butylsulfinyl and phenylsulfinyl), an oxycarbonyl group (e.g., butoxycarbonyl, naphthoxycarbonyl, hexyloxycarbonyl and phenoxycarbonyl), an acyl group (e.g., benzoyl and octanoyl), an acyloxy group (e.g., benzoyloxy and octanoyloxy), a phosphoric acid amide group (e.g. N,N-dipropylphosphoric amide), an alkylthio group (e.g., butylthio, pentylthio, hexylthio and decylthio), an arylthio group (e.g., phenylthio), or the like. As examples of the substituents, those explained in $R_a$, a hydroxyl group, a halogen group (e.g., fluorine, chlorine, bromine or iodine), an amino group, a nitro group, a cyano group, a sulfonic group, a carboxyl group, a methyl group, an ethyl group, a propyl group, an isopropyl group, or the like can be mentioned.

Examples of the substituent for the benzene ring include a hydroxyl group, a halogen group (e.g., fluorine, chlorine, bromine or iodine), an amino group, a nitro group, a cyano group, a sulfonic group, a carboxyl group, a methyl group, an ethyl group, a propyl group, an isopropyl group, or the like.

Preferably, $R_a$ is a substituted or unsubstituted group having 6 or more and 12 or less carbon atoms, including an acylamino group, a ureido group, a urethane group, a sulfonamido group, a carbamoyl group, or an oxycarbonyl group, and most preferably, $R_a$ is a substituted or unsubstituted group having 6 or more but 12 or less carbon atoms, including an acylamino group, a ureido group, and an carbamoyl group.

M is preferably a hydrogen atom, an alkali metal atom, an alkaline earth metal atom, a nickel atom, a zinc atom, a cadmium atom, an iron atom, or a lead atom, more preferably a zinc atom, a calcium atom, or a cadmium atom, and particularly preferably a zinc atom.

The compounds represented by general formulae (3) to (5) are a mercaptotetrazole compound, a mercaptotriazole compound, a mercaptoimidazole compound, a mercaptothiadiazole compound, a mercaptooxadiazole compound, or the like.

Each of X represent a nitrogen atom or C—H. Y is an oxygen atom, or a sulfur atom.

$R_b$ is a substituted or unsubstituted group including an alkyl group (e.g., decyl, dodecyl and hexadecyl), a cycloalkyl group (e.g., butylcyclohexyl), an alkenyl group (e.g., 3-decenyl), an alkynyl group (e.g., decynyl), an aralkyl group (e.g., 4-butylbenzyl and 3-propylphenethyl), an aryl group (e.g., 4-butylphenyl, and naphthyl), a heterocyclic group (e.g., quinolyl, and quinoxalinyl), an alkoxy group (e.g., dodecyloxy), an aryloxy group (e.g., 2-naphthyloxy), an amino group (e.g., didecylamino, dipentylamino, and dibenzylamino), an acylamino group (e.g., decylamino, 2-butylhexanoylamino, and dodecanoylamino), a ureido group (e.g., N-naphthylureido, decylureido, and dodecylureido), a thioureido group (e.g., N-naphthylthioureido, and decylthioureido), a urethane group (e.g., naphthoxycarbonylamino, and decyloxycarbonylamino), a sulfonamide group (e.g., decanesulfonamido, and naphthalenesulfonamido), a sulfamoyl group (e.g., N,N-pentyloctylsulfamoyl, N-naphthylsulfamoyl, and dipentylsulfamoyl), a carbamoyl group (e.g., N,N-dipentylcarbamoyl, N,N-phenylbutylcarbamoyl, and dodecylcarbamoyl), a sulfonyl group (e.g., tosyl), a sulfinyl group (e.g., decylsulfinyl, and naphthylsulfinyl), an oxycarbonyl group (e.g., decyloxycarbonyl, and naphthoxycarbonyl), an acyl group (e.g., butylbenzoyl), an acyloxy group (e.g., penthylbenzoyloxy), an phosphoric acid amido group (e.g., N,N-dipentylphosphoric amido), an alkylthio group (e.g., decylthio), an arylthio group (e.g., naphthylthio), or the like. These groups may be further substituted. Examples of the substituents that further substitute include, substituents explained in $R_b$, a hydroxyl group, a halogen group (fluorine, chlorine, bromine, and iodine), an amino group, a nitro group, a cyano group, a sulfonic group, a carboxyl group, a methyl group, an ethyl group, a propyl group, an isopropyl group, or the like.

The total number of carbon atoms of $R_b$ is generally 10 or more.

$R_b$ is preferably a substituted group, including an aryl group (e.g., phenyl, naphthyl, and anthracenyl), an acylamino group, a ureido group, a urethane group, a sulfonamide group, a carbamoyl group, and an oxycarbonyl group. Examples of the substituted are a carbamoyl group having an alkyl group such as a butyl, a hexyl, an octyl or a nonyl; an amido group having the same alkyl group; a ureido group having the same alkyl group; an alkylcarboxylic acid ester group, or the like. In addition to have 10 or more carbon atoms in total, preferably, the five-membered ring has an aromatic ring group that binds directly thereto.

M has the same meaning as in general formulae (1) and (2). That is, preferably, M is a hydrogen atom, an alkali metal atom, an alkaline earth metal atom, a nickel, a zinc, a cadmium, an iron, or a lead, more preferably, a zinc, a calcium or a cadmium, and particularly preferably a zinc.

$R_c$ and $R_d$ are each independently a substituted or unsubstituted group, including an alkyl group (e.g., n-butyl, t-butyl, n-octyl, dodecyl, and hexadecyl), a cycloalkyl group (e.g., cyclopentyl, and cyclohexyl), an alkenyl group (e.g., allyl, 2-butenyl, and 3-pentenyl), an alkynyl group (e.g., propargyl, and 3-pentynyl), an aralkyl group (e.g., benzyl, and phenethyl), an aryl group (e.g., phenyl, naphthyl, and 4-methylphenyl), a heterocyclic group (e.g., pyridyl, furyl, imidazolyl, piperidinyl, morpholyl, and thienyl), an alkoxy group (e.g., methoxy, ethoxy, butoxy, 2-ethylhexyloxy, ethoxyethoxy, methoxyethoxy, and dodecyloxy), an aryloxy group (e.g., phenoxy, and 2-naphthyloxy), an amino group (e.g., unsubstituted amino, dimethylamino, diethylamino, dipropylamino, dibutylamino, ethylamino, dibenzylamino, and anilino), an acylamino group (e.g., acetylamino, benzoylamino, octanoylamino, 2-ethylhexanoylamino, and dodecanoylamino), a ureido group (e.g., unsubstituted ureido, N-methylureido, N-phenylureido, hexylureido, octylureido, and dodecylureido), a thioureido group (e.g., unsubstituted thioureido, N-methylthioureido, N-phenylthioureido, and octylthioureido), a urethane group (e.g., methoxycarbonylamino, phenoxycarbonylamino, and hexyloxycarbonylamino), a sulfonamido group (e.g., methanesulfonamido, benzenesulfonamido, and octanesulfonamide), a sulfamoyl group (e.g., unsubstituted sulfamoyl group, N,N-dimethylsulfamoyl, N-phenylsulfamoyl, and dibutylsulfamoyl), a carbamoyl group (e.g., unsubstituted carbamoyl, N,N-diethylcarbamoyl, N-phenylcarbamoyl, octylcarbamoyl, dodecylcarbamoyl), a sulfonyl group (e.g., mesyl, and tosyl), a sulfinyl group (e.g., methylsulfinyl, and phenylsulfinyl), an oxycarbonyl group (e.g., methoxycarbonyl, ethoxycarbonyl, hexyloxycarbonyl, and phenoxycarbonyl), an acyl group (e.g., acetyl, benzoyl, formyl, pivaloyl, and octanoyl), an acyloxy group (e.g., acetoxy, benzoyloxy, and octanoyloxy), an phosphoric acid amido group (e.g., N,N-diethylphosphoric amido), an alkylthio group (e.g., methylthio, ethylthio, hexylthio, and decylthio), an arylthio group (e.g., phenylthio), a cyano group, a sulfo group, a carboxy group, a hydroxy group, a phosphono group, a nitro group, or the like. These groups may be further substituted. Examples of the substituents for the further substitution are, those explained in $R_c$ and $R_d$, and a hydroxyl group, a halogen group (e.g., fluorine, chlorine, bromine, and iodine), an amino group, a nitro group, a cyano group, a sulfonic group, a carboxyl group, a methyl group, an ethyl group, a propyl group, an isopropyl group, or the like.

$R_c$ and $R_d$ are each independently selected from a substituted or unsubstituted alkyl group (e.g., butyl, hexyl, octyl, decyl, or the like), a substituted or unsubstituted alkenyl group (e.g., butenyl, octenyl, or the like), a substituted or unsubstituted aralkyl group (e.g., benzyl, phenethyl, or the like), a substituted or unsubstituted aryl group (e.g., phenyl, biphenyl, amidophenyl, phenoxyphenyl, naphthyl, anthracenyl, or the like), or a substituted or unsubstituted heterocyclic group (e.g., pyridyl, thienyl, furyl, or the like).

Preferably, the sum of carbon atoms of $R_c$ and $R_d$ is 12 or more, and in addition, they preferably have an aromatic ring. Further, preferably, the aromatic ring group binds directly to the five-membered ring.

To achieve high sensitivity and low Dmin, combined use of a compound represented by general formula (1) or (2) having no mercapto group, and a compound selected from a compound represented by general formula (1) or (2) having a mercapto group or a compound represented by any one of general formulae (3) to (5), is preferable. Combined use of a compound represented by general formula (1) or (2) having no mercapto group, and a compound represented by any one of general formulae (3) to (5), is more preferable.

It is also preferable to use a nitrogen-containing heterocyclic compound which has a partition coefficient for butanol and water at pH 11, a common logarithm of which is 0.5 or more.

The partition coefficient of butanol to water can be obtained by the following procedure. 50 cc of a n-butanol solution of $2\times10^{-4}$ mol/l of a test compound was mixed with 50 cc of Britton-Robinson buffer (pH 11) prepared using distilled water, at an ordinary temperature, the resulting mixture was shaken with a shaker for 10 minutes and then left to stand. Then, the solution was separated into the n-butanol phase (A liquid) and the water phase (B liquid). The extracted A and B liquids were diluted by n-butanol liquid and buffer liquid, respectively, at a certain rate. The concentrations of both liquids were measured by a spectral absorption measurement method or an HPLC method at a measurement temperature of 25° C. The common logarithm of the partition coefficient was calculated from the concentration of each respective liquid.

(Partition coefficient)=[Concentration in n-butanol phase]/[Concentration in buffer phase]

These compounds are added to an emulsion layer in accordance with an ordinary method for adding photographic emulsion additives. These compounds can be added as a solution, by being dissolved in, for example, methyl alcohol, ethyl alcohol, water, methylpropylglycol, or a mixed solvent thereof. Acids or alkalis may be added to the solution, or the solution may be concentrated. The compound may be added to an oil used in a gelatin dispersion of a coupler. As disclosed in JP-A-59-174830, preferably, the compound may be used in the form of a dispersion of fine particles in a hydrophilic binder. In this case, the average diameter of the fine particles is 0.001 to 5 $\mu$m, preferably 0.01 to 2 $\mu$m.

Preferably, these compounds are added to a silver halide emulsion layer. They may be added to any layer, such as an intermediate layer, a protective layer, a subbing layer, and an antihalation layer.

The amount of the compound to be added is generally $10^{-5}$ to 1 mole per one mole of the silver halide, preferably in the range of $5\times10^{-4}$ to $5\times10^{-1}$ mole, and further preferably in the range of $10^{-3}$ to $10^{-1}$ mole, when the compound is added to the silver halide emulsion layer.

Further, when the compound is added to a layer other than the silver halide emulsion layer, the compound is added preferably to give a concentration 10 times of the concentration of the above case.

These compounds may be added at any time of steps for preparing a photographic emulsion, and at any stage after the preparation of an emulsion to immediately before its coating. Preferably, they may be added at the time of preparation of the coating solution; e.g., before, during, or after the chemical sensitization, but after the addition of a sensitizing dye.

Specific examples of the compound represented by general formulae (1) to (5) are shown below, but the present invention is not limited to these examples.

N-1

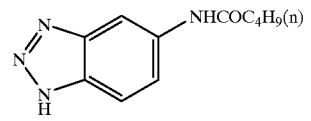

N-2

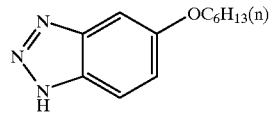

N-3

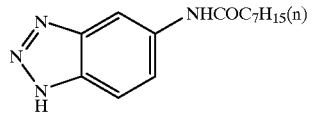

N-4

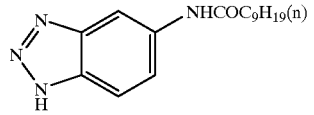

N-5

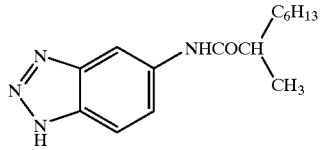

N-6

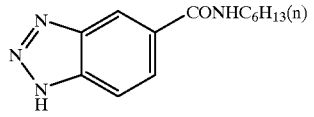

N-7

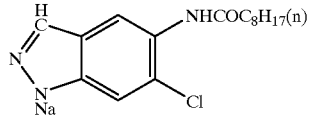

N-8

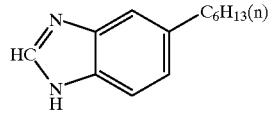

N-9

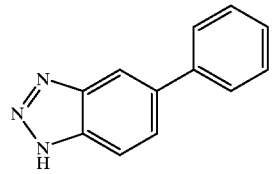

N-10

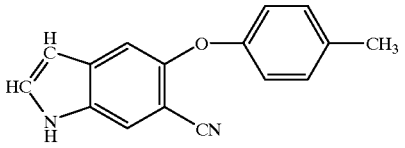

-continued
N-11
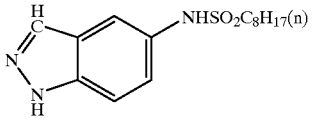
N-12
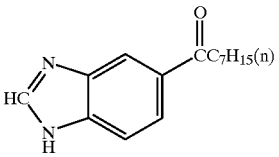
N-13
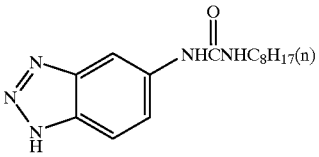
N-14
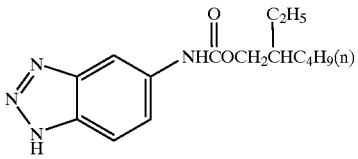
N-15
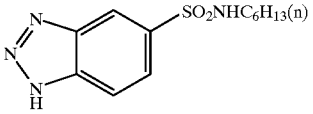
N-16
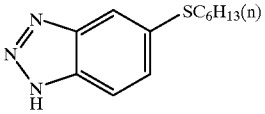
N-17
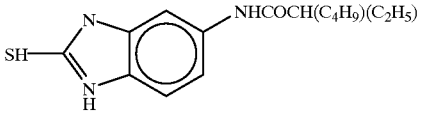
N-18
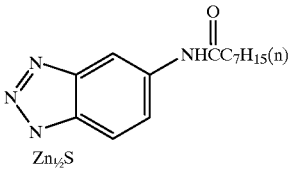
N-19
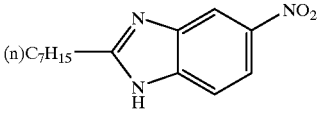
N-20
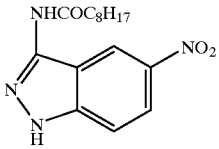
-continued
N-21
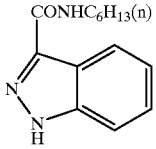
N-22
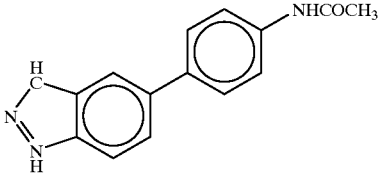
N-23
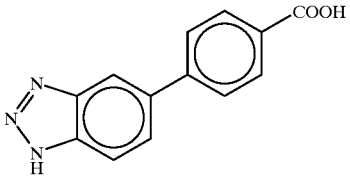
N-24
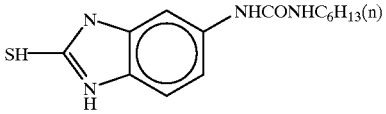
N-25
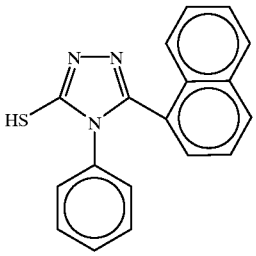
N-26
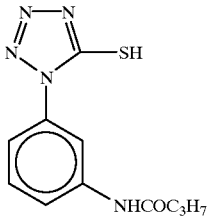
N-27
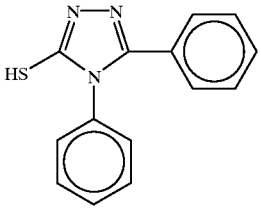

-continued
N-28
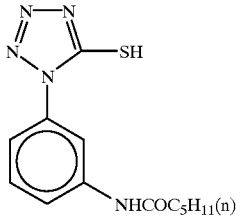
N-29
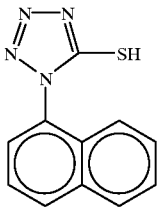
N-30
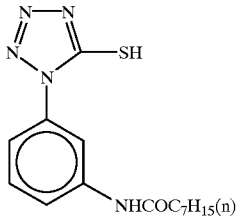
N-31
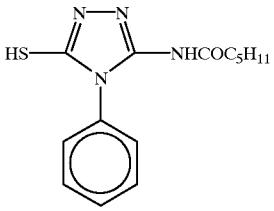
N-32
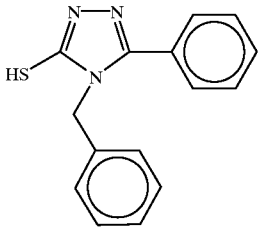
N-33
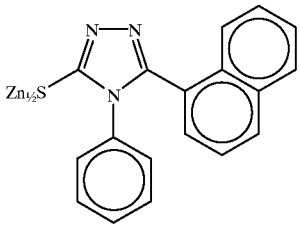
-continued
N-34
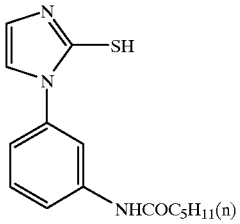
N-35
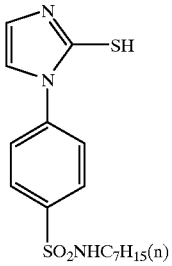
N-36
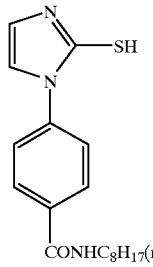
N-37
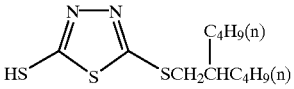
N-38
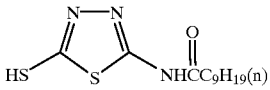
N-39
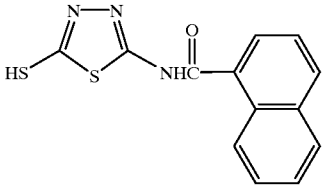
N-40
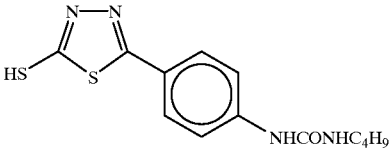
N-41
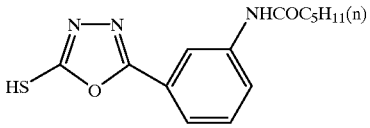

-continued

N-42

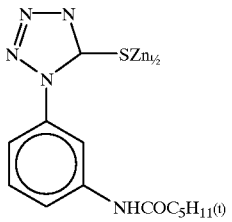

U.S. Pat. No. 3,649,267, JP-A-62-291642, JP-A-8-54705, JP-A-8-54724, JP-A-9-218485, JP-A-10-90853, JP-A-10-90848, and the like, also disclose specific examples of nitrogen-containing heterocyclic compounds.

The nitrogen-containing heterocyclic compounds that disclosed in U.S. Pat. No. 3,649,267, JP-A-62-291642, JP-A-8-54705, and JP-A-8-54724 are metal salts. Compared to the feature of the present invention, wherein the existence of divalent metal ions in an amount equimolar or more to the nitrogen-containing heterocyclic compound represented by general formulae (1) to (5) is essential, when these antifoggants are used singly, much desensitization occurs in usual color development processing, and effects required in the present invention cannot be achieved. In these publications/patents shown above, it is intended to prevent fogging of light-sensitive materials in heat-development and/or diffusion transfer processing. Therefore, they do not disclose the present invention which attains suppression of fogging and high sensitivity at the same time, with a (heat-developable) color light-sensitive material containing therein a compound that forms a dye by a coupling reaction with the oxidization product of a developing agent, and the developing agent built in the material, in both heat-development and conventional color liquid development.

The nitrogen-containing heterocyclic compound for use in the present invention can be easily synthesized by a known method.

Examples of the halogen composition usable in the light-sensitive silver halide emulsion for use in the present invention include silver chloride, silver iodochloride, silver chlorobromide, silver iodochlorobromide, silver iodobromide, and those having an arbitrary composition can be preferably used. Further, other silver salts, for example, organic silver, such as silver thiocyanate, silver sulfide, silver selenide, silver carbonate, silver phosphate, benzotriazole silver, or the like, may be included in the silver halide grains in the form of a solid solution, or they may be junctioned.

The halogen composition may be uniform, or it may be different between the inside and the surface of a grain. In the latter case, the silver halide emulsion grain is a multiple-structure, laminated-structure grain, or the like. Further, sliver halide emulsion grains having different compositions may be joined by epitaxial junction.

A high-silver-chloride emulsion, having a silver chloride content of 50 mol % or more, is generally characterized by high development activity. In addition, such a silver chloride emulsion provides less haze on a image. Therefore, the emulsion is preferable, because it is characterized to exhibit less deterioration of the image information, when the developed light-sensitive material is read by a scanner, without fixing. The silver chloride content is preferably 70 mol % or more.

Those having localized phases that have different compositions, in a layered or non-layered structure, inside and/or on the surface of silver halide grains, may be used as well. The halogen composition of a localized phase is analyzed by X-ray diffractometry, analytical electron microscopy, and the like. The method of application of X-ray diffractometry to silver halide is described, for example, in "Photographic Science and Technology", by C. R. Berry and S. J. Marino, Vol. 2, p. 149, (1955), and Vol. 4, p. 22, (1957). The localized phase can exist inside or at the edges, corners, and planes of the surface of the grain, as one preferable example, one formed by epitaxial junction in a corner of a grain can be mentioned. Those examples are described in JP-A-58-108526, JP-A-59-133540, JP-A-59-119350, JP-A-6-194768, and EP No. 0699944.

A light-sensitive material composed mainly of silver iodobromide is desirable in terms of providing high sensitivity, as in the case of a conventional light-sensitive material for photographing. In the case of such a silver halide emulsion, it may also contain silver chloride. In such a case, the silver chloride content is preferably 8 mol % or less, and more preferably 3 mol % or less.

In the present invention, it is preferable to employ a light-sensitive silver halide emulsion containing grains that have a laminated structure comprising plural layers, which are different in halogen composition, which grains contain inside a grain that has at least one layer having a higher silver iodide content than either of the adjacent layer at the inner side of the grain or the adjacent layer at the surface side of the grain.

If a light-sensitive silver halide emulsion composed of silver chlorobromide, silver chloride, or the like is used, silver iodide may be contained therein, and, in this case the silver iodide content is preferably 6 mol % or less, and more preferably 2 mol % or less.

Use of a light-sensitive emulsion having a high-silver-chloride content is advantageous in terms of rapid processing, but, it is disadvantageous in terms of adsorption of a sensitizing dye. However, the adsorption of the sensitizing dye can be enhanced by making the composition of the surface of the grain rich in silver iodide or silver bromide.

The halogen composition at the surface of a light-sensitive silver halide emulsion grain is measured by X-ray photoelectron spectroscopy (ESCA).

The halogen composition distribution among the light-sensitive silver halide emulsion grains (silver bromide content, silver iodide content, and silver chloride content) is preferably narrow. The coefficient of variation of the halogen composition distribution is preferably 3 to 30%, more preferably 3 to 25%, and particularly preferably 3 to 20%. In this connection, the above-mentioned coefficient of variation means a value obtained by dividing a scattering (standard deviation) by an average.

The halogen composition distribution in each light-sensitive silver halide emulsion can be analyzed by, for example, an X-ray microanalyzer (EPMA).

The shape of the silver halide grains can be chosen from regular crystals having no twin plane, single twins having one twin plane, parallel multiple twins having two or more parallel twin planes, non-parallel multiple twins having two or more non-parallel twin planes, a spherical shape, a potato-like shape, a tabular shape having a high-aspect ratio, and a composite system thereof; and they are used in accordance with the purpose. The shape of the twin grains is described in "Shashin Kogaku no Kiso—Ginen Shashin-hen—", edited by Nihon Shashin-gakkai (Corona, Co.), page 163. In the present invention, a tabular grain is preferable.

In the case of regular crystals, cubic grains having (100) planes, octahedral grains having (111) planes, or dodecahedral grains having (110) planes can be used. The dodecahedral grains are described in JP-B-55-42737 ("JP-B" means examined Japanese patent application) and JP-A-60-222842. These are also reported in "Journal of Imaging Science", Vol.30, page 247, (1986). Grains having (h11) planes, (hh1) planes, (hk0) planes, or (hk1) planes can be used, depending on the purpose. A 14-hedral grains having (111) planes and (100) planes, and grains having (111) planes and (110) planes, can be used as well. If necessary, polyhedron grains, such as 38-hedrons, eccentrically rhombic 24-hedrons, 46-hedrons, 68-hedrons, or the like, can be used. In the high-silver-chloride content emulsion, to produce a plane other than a (100) plane, a crystal-habit-controlling agent is required. The formation of grains having a high-silver-chloride content, and having {111} planes, (for example, with a method using monopyridinium salts disclosed on pages 4 to 6 of JP-A-8-227117, or bispyridinium salts disclosed in JP-A-2-32, as a crystal-habit-controlling agent) is preferable in terms of the adsorption of dyes.

With respect to the shape of the tabular light-sensitive silver halide grain in the light-sensitive silver halide emulsion, if principal (main) planes (outer surfaces being parallel, and having the largest area) have (111) planes, grains are those parallel multiple twins having 2 or more parallel twin planes, and, if outer surfaces have (100) planes, they have no twin plane. The interval between twin planes can be made 0.012 $\mu$m or less, as described in U.S. Pat. No. 5,219,720. Further, as described in JP-A-5-249585, a value obtained by dividing a distance between (111) principle planes by the interval between twin planes can be made 15 or more.

If the above-mentioned principal planes are (111) planes, the shape of the light-sensitive silver halide emulsion grain, when seen from above, is circular shape, triangular shape, hexagonal shape, or roundishly circular shapes formed from these shapes.

Even if the main planes are (111) planes, side planes connecting the main planes may be (111) planes, (100) planes, or mixed-planes thereof, and further, side planes may contain a plane having a larger index.

In a high-silver-chloride content emulsion, those having (111) planes as main planes are preferable over those having (100) planes, in view of less fogging.

If the outer surfaces are (100) planes, the shape of a light-sensitive silver halide emulsion grain, when seen from above, is rectangular shape.

In the light-sensitive silver halide emulsion for use in the present invention, preferably, the tabular light-sensitive silver halide grains occupy 80 to 100% of the total projected area of the silver halide grains, more preferably 90 to 100%, and particularly preferably 95 to 100%.

In the light-sensitive silver halide emulsion for use in the present invention, the average grain thickness of the tabular light-sensitive silver halide grains is preferably 0.005 to 0.2 $\mu$m, and more preferably 0.01 to 0.15 $\mu$m. In this connection, the above average grain thickness means an arithmetic mean of the thickness of all tabular grains in the light-sensitive silver halide emulsion.

In the light-sensitive silver halide emulsion, the circle-equivalent diameter of the average projected area of the tabular light-sensitive silver halide grains is preferably 0.2 to 8 $\mu$m, more preferably 0.3 to 5 $\mu$m, and particularly preferably 0.4 to 4 $\mu$m.

The ratio of the circle-equivalent diameter to the average thickness of the tabular light-sensitive silver halide grains in the light-sensitive silver emulsion is called an "aspect ratio". The average aspect ratio of the tabular light-sensitive silver halide grains according to the present invention is preferably 3 to 100, and more preferably 6 to 80. The average aspect ratio represents an arithmetic mean of the aspect ratios of all tabular grains in the light-sensitive silver halide emulsion.

If the shapes of the projected area of the above-mentioned tabular light-sensitive silver halide grains in the light-sensitive silver halide emulsion are rectangular, the tabular grains, which have a ratio of a side having a maximum length to side having a minimum length of 1 to 2, occupy preferably 50 to 100% of the projected area of all grains, and more preferably 70 to 100%. Further, tabular grains having an almost square shape, in which the above ratio is nearly 1, are preferable.

The shape of the light-sensitive silver halide emulsion grains can be measured by a transmission electron microscope, in accordance with a carbon replica method, wherein both the light-sensitive silver halide emulsion grains and a latex sphere for reference, which is used as a standard for size, are simultaneously provided shadowing with heavy metals or the like.

The use of a monodispersed light-sensitive silver halide emulsion having a narrow distribution of grain size is preferable. The above-mentioned monodispersed light-sensitive silver halide emulsion represents those having coefficients of variation in the grain size distribution of 30% or less. The method for using the monodispersed light-sensitive silver halide emulsion is described in "Surfactant Science Series (Technological applications of dispersions)", by Trevor Maternaghan, Vol. 52, p. 373, (1994).

Further, a polydispersed light-sensitive silver halide emulsion having a wide distribution of grain size may be used as well.

Moreover, as described in JP-A-1-167743 and JP-A-4-223463, for the purpose of adjusting gradation, two or more types of monodispersed light-sensitive silver halide emulsions, each having a different grain size but having substantially the same color sensitivity, can be used in combination. Two or more types of monodispersed light-sensitive silver halide emulsions can be mixed in the same layer, or they may constitute layers separately. Two or more types of polydispersed light-sensitive silver halide emulsions, or a combination of a monodispersed light-sensitive silver halide emulsion and a polydispersed light-sensitive silver halide emulsion, can be used.

Methods for preparing tabular grains having (111) planes, and comprising silver bromide, silver iodobromide, or silver chlorobromide, are described in JP-A-55-142329, JP-A-58-113926, JP-A-58-113927, JP-A-58-113928, U.S. Pat. No. 4,914,014, U.S. Pat. No. 4,942,120, JP-A-2-222940, U.S. Pat. No. 5,013,641, and U.S. Pat. No. 4,414,306. Among these, methods for forming tabular grains using a polyalkyloxide compound described in each specification of U.S. Pat. Nos. 5,147,771 to 5,147,773, and U.S. Pat. Nos. 5,171,659, 5,210,013, and 5,252,453, are preferable.

To form tabular grains having a high average aspect ratio in the light-sensitive silver halide emulsion, formation of a small-sized twin nucleus is important. To form such a nucleus, the nucleus formation is preferably carried out by making low temperature, high pBr, and low pH; by reducing the amount of gelatin; by using a gelatin having a low methionine content, a low-molecular gelatin, or a phthalated gelatin derivative; and by shortening the time for the formation of the nucleus.

After the formation of nuclei, the nuclei of parallel multiple twins are formed selectively through a physical ripening by allowing only the nuclei of tabular grains (parallel multiple twin nuclei) to grow, and allowing nuclei of other grains, i.e. nuclei of regular crystals, nuclei of single twins, and nuclei of non-parallel multiple twins, to disappear. Then, after adding a soluble silver salt and a soluble halide salt, or adding a small-sized silver halide fine-grain emulsion, grains are grown, and the light-sensitive silver halide emulsion containing the tabular grains is prepared.

Preparation methods of tabular grains having (100) planes, and comprising silver bromide or silver chlorobromide, are described in U.S. Pat. No. 4,063,951 (by T. G. Bogg), JP-A-58-95337 (by A. Mignot), JP-A-7-234470, JP-A-8-339044, and JP-A-6-308648 (by Saito).

Tabular grains having (111) planes, and comprising a high-silver chloride content emulsion, are described in U.S. Pat. Nos. 4,399,215, 4,400,463, and 5,217,858, and JP-A-2-32. When a high-silver chloride is used, ordinarily, outer surfaces become (100) planes, in a condition of no adsorbable substance. Therefore, using an adsorbable substance having a plane-selectivity on (111) planes, and, after allowing nuclei of twins to form, then allowing nuclei of regular crystals, nuclei of single twins, and nuclei of non-parallel multiple twins to disappear at a physical ripening step, to obtain nuclei of parallel multiple twins selectively, then grains are grown, and thereby a light-sensitive silver halide emulsion containing the tabular grains is prepared.

Furthermore, a empirical rule of formation of silver chloride tabular grains having (111) planes is reported in "Journal of Photographic Science", Vol. 36, p. 182, (1988).

Tabular grains having (100) planes, and comprising high-silver content emulsion grains are described in U.S. Pat. Nos. 4,946,772, 5,275,930, and 5,264,337, JP-A-5-281640, JP-A-5-313273, JP-A-6-308648, JP-A-7-234470, JP-A-8-339044, and European Patent No.0534395A1. The formation of nuclei that grow to be tabular is an important point, and it is effective to conduct, at the initial stage of the grain formation, addition of bromide ion or iodide ion, or addition of a compound exhibiting selective adsorption on a specific plane. After the formation of the nuclei, physical ripening and grain growth are conducted, to prepare a light-sensitive silver halide emulsion containing the tabular grains. The grain growth is carried out by adding soluble silver salt and soluble halide salt, or a small-sized silver halide fine grain emulsion.

Since the surface area of such a tabular grain is larger than that of a regular crystal having the same volume as the tabular grain, such a tabular grain is able to increase the amount of sensitizing dyes to be adsorbed, and thus it is advantageous in view of color sensitization sensitivity. Accordingly, in contrast to regular crystal grain, the same level of sensitivity can be obtained with smaller volume. Further, as the number of grains increases, the number of a starting site of development increases, thus excellent graininess, which is an important property in a light-sensitive material for photography, can be obtained. Further, by virtue of the excellent graininess as described above, reduction of the coating amount of silver is possible, and thus the tabular grain is excellent in prevention of radiation fogging, which has been a problem of a light-sensitive material for high-sensitivity photography.

Reducing the coating amount of silver is effective to reduce haze that causes the deterioration of image information, when the image is read by a scanner from a processed light-sensitive material that is not fixed.

Since the tabular grains have a large specific surface area, they are characterized by having high developing activity. Moreover, the tabular grains align in orientation at the time of application, making it possible to make a light-sensitive material to be a thin-layer, and the obtained photographic material is excellent in sharpness. Thus, the tabular grain is an indispensable emulsion grain for a light-sensitive material for photographing.

As long as resistance to damage by pressure and monodispersibility of grain distribution are not damaged, tabular grains having a larger average aspect ratio are preferable, in terms of sensitivity, graininess, activity, and reduction of the amount of silver to be coated.

The tabular light-sensitive silver halide grains, in the light-sensitive silver halide emulsion for use in the present invention, may have dislocation lines.

A technology to introduce dislocation lines with control is described in JP-A-63-220238. The tabular grains wherein dislocation lines have been introduced are excellent in photographic characteristics, such as sensitivity, reciprocity law, etc., in contrast to tabular grains having no dislocation lines. Preferable methods to introduce dislocation lines are described in U.S. Pat. Nos. 5,498,516, 5,496,694, and 5,527,664. It is preferable to use the tabular grains prepared by using these technologies for the present invention.

If the tabular grains in the light-sensitive silver halide emulsion used in the present invention have dislocation lines, the place can be arbitrarily selected from limited introduction at a top portion, or a fringe portion of the grain, or introduction to whole portions of the main plane of the grain, or the like. Particularly preferably, the place is to be limited to the fringe portion.

In the present invention, the fringe portion of grain represents an outer periphery of a tabular grain. In detail, in the distribution of silver iodide extending from an edge to the center of the tabular grain, the fringe portion represents an outer region of a point where the silver iodide content first becomes higher or lower than the average content of silver iodide of the whole grain, when seen from the edge of the tabular grain.

In the present invention, if the tabular grain has dislocation lines, the density of the dislocation lines may be arbitrarily selected, i.e., any number of dislocation lines per one grain can be selected, depending on each case, from, for example, 10 or more, 30 or more, 50 or more, etc.

As a protective colloid that is used when the emulsion according to the present invention is prepared, gelatin is used advantageously, but another hydrophilic binder can also be used. The hydrophilic binder can be used singly or in combination with gelatin. As a hydrophilic binder, preferable, use can also be made of, for example, a gelatin derivative, a graft polymer of gelatin with another polymer, a protein, such as albumin and casein; a cellulose derivative, such as hydroxyethylcellulose, and cellulose sulfate ester; sodium alginate, a starch derivative, a polysaccharide, carrageenan, and synthetic hydrophilic polymers, including homopolymers and copolymers, such as a polyvinyl alcohol, a modified alkylpolyvinyl alcohol, a polyvinyl-N-pyrrolidone, a polyacrylic acid, a polymethacrylic acid, a polyacrylamide, a polyvinylimidazole, a polyvinylpyrazole, and thioether polymer described in U.S. Pat. No. 3,615,624.

As a gelatin, in addition to lime-processed gelatin, acid-processed gelatin, de-ashed gelatin, gelatin derivatives, such as, phthalated gelatin, trimellitated gelatin, carbamoyl gelatin, succinated gelatin, esterified gelatin, and gelatin that is low-molecular, can be used when the tabular grains are formed. It is known that gelatin subjected to oxidation treatment with an oxidizing agent, such as hydrogen peroxide, is useful in forming tabular grains. In addition, a gelatin treated with an enzyme, as described in "Bull. Soc. Photo. Japan" No. 16, p. 30, (1966), can be used as a low-molecular gelatin. Hydrolyzate or enzymolyzate of gelatin can also be used.

In the process of grain formation or physical ripening of silver halide, metal salt (including complex salt) can be coexisted. Examples of the metal salt include, salt or complex salt of noble metal or metal, such as cadmium, zinc, lead, thallium, iridium, platinum, palladium, osmium, rhodium, chromium, ruthenium, rhenium, cobalt, gallium, copper, nickel, manganese, indium, tin, calcium, strontium, barium, aluminum, bismuth or the like. These compounds may be used singly or in a combination of 2 or more kinds. The amount to be added is around $10^{-9}$ to $10^{-3}$ moles per mole of the silver halide. These metals may be used in the form of a water-soluble salt, such as a six-coordinate complex, or a four-coordinate complex salt or an ammonium salt, an acetate, a nitrate, a sulfate, a phosphate, or a hydrochloride. Examples of complex ion and coordinate compounds that can be preferably used include bromide ion, chloride ion, cyanide ion, nitrosyl ion, thiocyanide ion, thionitrosyl ion, water, ammonia, oxo, carbonyl, or the like, and combinations thereof. For example, yellow prussiate of potash, $K_2IrCl_6$, $K_3IrCl_6$, $(NH_4)_2RhCl_5(H_2O)$, $K_2RuCl_5(NO)$, $K_3Cr(CN)_6$, $K_4Ru(CN)_6$, $CdCl_2$, $Pb(CH_3COO)_2$, or the like can be preferably used. Further, the position of a silver halide grain to which these compounds are incorporated, may be uniformly inside of the grain, or may be a localized position at the surface or inside, etc., of the grain, or a localized phase of silver bromide, or a high-silver-chloride grain-base. The addition method of these compounds includes a method wherein an aqueous solution of halide, or a solution of a water-soluble silver salt, for use at the time of grain formation, is mixed with a solution of the above metal salt, and then the mixture is added continuously during the grain formation; a method wherein silver halide emulsion fine grains to which the above metal ions are doped, are added; or a method wherein the solution of the above metal salt is directly added, before, during, or after the formation of the grains. During the formation of the grains, the above metal salt solution can be continuously added.

In some cases, a method wherein a chalcogenide compound is added during the preparation of the emulsion, as described in U.S. Pat. No. 3,772,031, is also useful. In addition to S, Se, and Te, a cyanate, a thiocyanate, a selenocyanate, a carbonate, a phosphate, or an acetate may be present.

The light-sensitive silver halide emulsion in the present invention can be used even if it is not chemically sensitized; however, generally it is used after being chemically sensitized. The chemical sensitization methods used in the present invention include the chalcogen sensitization method, such as the sulfur sensitization method, the selenium sensitization method, and the tellurium sensitization method; the noble metal sensitization method using gold, platinum, palladium, or the like; and the reduction sensitization method, and they can be used singly or in combination (e.g. JP-A-3-110555 and JP-A-5-241267). These chemical sensitizations can be carried out in the presence of a nitrogen-containing heterocyclic compound (JP-A-62-253159). Further, the below-mentioned antifoggant can be added after the completion of the chemical sensitization. Specifically, methods described in JP-A-5-45833 and JP-A-62-40446 can be used.

In the present invention, there is no limitation on pAg and pH of an emulsion on which sulfur sensitization, selenium sensitization or tellurium sensitization, and gold sensitization are conducted. However, preferably, the pAg is in the range of 5 to 11, while the pH is in the range of 3 to 10; more preferably the pAg is in the range of 6.8 to 9.0, while the pH is in the range of 5.5 to 8.5.

When gold sensitization is performed by using a metal ion of a cyano complex, at the time of the grain formation, to achieve high sensitivity, the addition of a metal ion, such as a zinc ion, that coordinates to gelatin, at the time before chemical sensitization or at the time of the dispersion of gelatin, is preferable.

For the purpose of preventing fogging and of increasing stability during storage, an antifoggant and a stabilizer may be added to the silver halide emulsion. The details of these compounds are described in "The Theory of the Photographic Process", by T. H. James, P.396–P.399, Macmillan (1977), and its references.

The timing when the antifoggant or the stabilizer is added to the silver halide emulsion may be at any stage in the preparation of the emulsion. The addition to the emulsion can be carried out at any time, singly or in combination, of after the completion of the chemical sensitization and during the preparation of a coating solution, at the time of the completion of the chemical sensitization, during the chemical sensitization, prior to the chemical sensitization, after the completion of the grain formation and before desalting, during the grain formation, or prior to the grain formation.

These antifoggant and stabilizer can be used also for the purpose of control of crystal habit, prevention of dissolution, and preparation of small sized emulsion grains; control of chemical sensitization; control of the alignment of sensitizing dye, in addition to the effects they originally have, such as prevention of fogging, or stabilization.

The amount of these antifogging agents or stabilizers to be added varies in accordance with the halogen composition of the silver halide emulsion and the purpose, and it is generally in the range of $10^{-6}$ to $10^{-1}$ mol, and preferably $10^{-5}$ to $10^{-2}$ mol, per mol of the silver halide.

In the present invention, preferably so-called spectral sensitization, for sensitizing the light-sensitive silver halide emulsion to a desired light wavelength range, is carried out. Particularly, in a color photographic light sensitive material, for color reproduction faithful to the original, light-sensitive layers having light sensitivities to blue, green, and red are incorporated. These sensitivities are provided by spectrally sensitizing the silver halide. In the spectral sensitization, use is made of a so-called spectrally sensitizing dye that is adsorbed to the silver halide grains, to cause them to have sensitivity in the range of its own absorption wavelength.

Dyes that can be used include a cyanine dye, a merocyanine dye, a composite cyanin dye, a composite merocyanine dye, a holopolar cyanine dye, a hemicyanine dye, a styryl dye, and a hemioxonol dye. Particularly useful dyes are those belonging to a cyanine dye, a merocyanine dye, and a composite merocyanine dye. In these dyes, any of nuclei generally used in cyanine dyes as base heterocyclic nuclei can be applied. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, and a pyridine nucleus; and a nucleus formed by fusing an cycloaliphatic hydrocarbon ring to these nuclei; a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, can be applied. These nuclei may be substituted on the carbon atom.

In the merocyanine dye or the composite merocyanine dye, as a nucleus having a ketomethylene structure, for example, a 5- to 6-membered heterocyclic nucleus, such as a pyrazolin-5-one nucleus, a thiohydantoine nucleus, a 2-thiooxazolidin-2,4-dione nucleus, a thiazolidin-2,4-dione nucleus, a rhodanine nucleus, and a thiobarbituric acid nucleus, can be applied.

Typical examples of sensitizing dye are described in U.S. Pat. No. 4,617,257, JP-A-59-180550, JP-A-64-13546, JP-A-5-45828, JP-A-5-45834, or the like.

The sensitive dyes for use in the present invention is known in the art and can be synthesized with reference to the following literature.

(a) F. M. Hamer; "Heterocyclic Compounds—Cyanine Dyes and related compounds" (John Wiley & Sons—New York, London, 1964)

(b) D. M. Sturmer; "Heterocyclic Compounds—Special Topics in heterocyclic chemistry" (John Wiley & Sons—New York, London, 1977)

These spectral sensitizing dyes can be used singly or in combination, and a single use or a combination use of these sensitizing dyes is selected for the purpose of adjusting the wavelength distribution of the spectral sensitivity, and for the purpose of supersensitization. When using a combination of the dyes having supersensitizing effect, it is possible to attain sensitivity much larger than the sum of sensitivities that can be attained by each single dye. Further, together with the sensitizing dye, it is also preferable to use a dye having no spectral sensitizing action itself, or a compound that does not substantially absorb visible light and that exhibits supersensitization. As an example of the supersensitizer, a diaminostilbene compound and the like can be mentioned. These examples are described, for example, in U.S. Pat. No. 3,615,641 and JP-A-63-23145.

The timing when the spectral sensitizing dye or the supersensitizer is added to the emulsion may be at any stage in the preparation of emulsions. The addition is carried out most usually at a time after the completion of chemical sensitization and before coating, but it can be carried out at the same time as the addition of a chemical sensitizer, to carry out spectral sensitization and chemical sensitization simultaneously, as described in U.S. Pat. Nos. 3,628,969 and 4,225,666; or it can be carried out prior to chemical sensitization, as described in JP-A-58-113,928. Further, it can be carried out before the completion of the formation of the precipitate of silver halide grains, to start spectral sensitization. Furthermore, as taught in U.S. Pat. No. 4,225,666, these foregoing compounds may be added in portions, i.e., partial addition that stretches over the steps, for example, part of these compounds is added prior to chemical sensitization, and the rest is added after the chemical sensitization; and also the addition may be carried out at any time during the formation of silver halide grains, as disclosed, for example, in U.S. Pat. No. 4,183,756.

The addition at a step before the chemical sensitization is preferable to obtain high sensitivity.

The amount of the spectral sensitizing dye or the supersensitizer to be added may vary depending on the shape of the grains, the size of the grains, and the desired photographic properties, and it is generally in the range of $10^{-8}$ to $10^{-1}$ mol, and preferably $10^{-5}$ to $10^{-2}$ mol, per mol of the silver halide.

These sensitizing dyes or supersenstizer can be added in the form of a solution of a hydrophilic organic solvent, such as methanol, alcohol containing fluorine, or methylproylglycol; as an aqueous solution, or as a mixture thereof. To increase solubility or preservability, these solutions may be adjusted to make them alkaline or acidic. They may be added in the form of an aqueous solution, using a surface-active agent, as described in JP-B-49-44. They may also be added in the form of a powder, prepared by dissolving the sensitizing dye, to mix with a dispersant, removing an auxiliary solvent or the like, and then drying the resultant, to be a powder, as described in JP-A-49-128725 and JP-B-49-8330. They may be added by allowing the dye to adsorb on fine particles of silica, as described in U.S. Pat. No. 3,649,286. They may be added by a method wherein, after adding an auxiliary dispersing agent, such as sorbitol, or a surface-active agent, to the dye, in water, the mixture is mechanically ground and dispersed, to be a slurry, and the mixture is dryed, and then it is added, as described in U.S. Pat. No. 4,006,025, JP-A-52-110012, JP-A-53-102733, and JP-A-53-102732. Moreover, they can be added by a method wherein, after mechanically grinding the sensitizing dye to make it 1 μm or less, and dispersing it, then the dispersion is further dispersed in a hydrophilic colloid, such as gelatin, which acts as an auxiliary dispersing agent, as described in JP-A-58-105141.

In order to reinforce the adsorption of the sensitizing dye, a soluble calcium compound, a soluble bromine compound, a soluble iodine compound, a soluble chlorine compound, or a soluble thiocyanate compound may be added before, after, and during the addition of the sensitizing dye. These compounds may be used in combination. Preferable examples of these compounds include $CaCl_2$, KI, KCl, KBr, and KSCN. These compounds may be in the state of fine particles of silver bromide, silver chlorobromide, silver iodobromide, silver iodide, and silver rhodanide emulsion particles.

Such additives for photography that can be used in the light-sensitive material of the present invention are described in more detail in Research Disclosures (hereinafter abbreviated to as RD) No. 17643 (December 1978), RD No. 18716 (November 1979), and RD No. 307105 (November 1989), and the particular parts are shown below.

| Kind of Additive | RD 17643 | RD 18716 | RD 307105 |
|---|---|---|---|
| Chemical sensitizers | p. 23 | p. 648 (right column) | p. 866 |
| Sensitivity-enhancing agents | — | p. 648 (right column) | — |
| Spectral sensitizers and Supersensitizers | pp. 23–24 | pp. 648 (right column)–649 (right column) | pp. 866–868 |
| Brightening agents | p. 24 | pp. 648 (right column) | p. 868 |
| Antifogging agents and Stabilizers | pp. 24–26 | p. 649 (right column) | pp. 868–870 |
| Light absorbers, Filter dyes, and UV Absorbers | pp. 25–26 | pp. 649 (right column)–650 (left column) | p. 873 |
| Image dye stabilizers | p. 25 | p. 650 (left column) | p. 872 |
| Hardeners | p. 26 | p. 651 (left column) | pp. 874–875 |
| Binders | p. 26 | p. 651 (left column) | pp. 873–874 |
| Plasticizers and Lubricants | p. 27 | p. 650 (right column) | p. 876 |
| Coating aids and Surfactants | pp. 26–27 | p. 650 (right column) | pp. 875–876 |
| Antistatic agents | p. 27 | p. 650 (right column) | pp. 876–877 |
| Matting agents | — | — | pp. 878–879 |

Usually the total amount of the light-sensitive silver halide used in the light-sensitive material is 0.05 to 20 g/m$^2$, and preferably 0.1 to 10 g/m$^2$, in terms of silver.

In the present invention, the light-sensitive silver halide may be used together with an organic metal salt as an oxidizing agent. Among such organic metal salts, organosilver salt is particularly preferably used.

As the organic compound that can be used to form the above organosilver salt oxidizing agent, benzotriazoles, aliphatic acids, and other compounds, as described in U.S. Pat. No. 4,500,626, columns 52 to 53, can be mentioned. Also useful is acetylene silver described in U.S. Pat. No. 4,775,613. Organosiliver salts may be used in the form of a combination of two or more.

The above organosilver salts may be used additionally in an amount of generally 0.01 to 10 mol, and preferably 0.01 to 1 mol, per mol of the light-sensitive silver halide.

As the binder of the constitutional layer of the light-sensitive material, a hydrophilic binder is preferably used. Examples thereof include those described in the above-mentioned Research Disclosures and JP-A-64-13546, pages (71) to (75). Specifically, a transparent or semitransparent hydrophilic binder is preferable, and examples include natural compounds such as proteins including gelatin, gelatin derivatives and the like, or polysaccharides including cellulose derivatives, starches, gum-arabic, dextrans, pullulan, and the like; and synthetic polymer compounds such as polyvinyl alcohols, modified polyvinyl alcohols (e.g. terminal-alkyl-modified POVAL MP103, MP203 and the like, trade name, manufactured by Kuraray Co., Ltd.), polyvinyl pyrrolidones, and acrylamide polymers. Further, highly water-absorptive polymers described, for example, in U.S. Pat. No. 4,960,681, and JP-A-62-245260; that is, homopolymers of vinyl monomers having —COOM or —$SO_3$M (M represents a hydrogen atom or an alkali metal), or copolymers of these vinyl monomers, or copolymers of the vinyl monomer(s) with another vinyl monomer (e.g., those comprising sodium methacrylate or ammonium methacrylate, including Sumika Gel L-5H, trade name, manufactured by Sumitomo Chemical Co., Ltd.) can also be used. Two or more of these binders can be used in combination. Particularly, combinations of gelatin with the above binders are preferable. Further, the gelatin can be selected from lime-processed gelatin, acid-processed gelatin; so-called de-ashed gelatin from which the calcium content, etc., have been reduced; low-molecular gelatin having a small molecular weight, and gelatin derivatives, such as phthalated gelatin, acylated gelatin, and esterified gelatin, in accordance with various purposes, and combinations thereof are also preferable.

In the present invention, the amount of a binder to be applied is 1 to 20 g/$m^2$, preferably 2 to 15 g/$m^2$, and further preferably 3 to 12 g/$m^2$.

According to the present invention, image-forming substances may be developed silver, and also dyes (dye-providing compounds) can be used as the image-forming substances. Using dye-providing compounds that form or release dyes, a monochromatic picture image formed by dyes can also be obtained.

As the reducing agent that can be used in the present invention, known reducing agents in the field of a heat-developable light-sensitive material can be used. Further, the later-described dye-providing compounds having reducibility are also included (in this case, other reducing agent can be used additionally). Further, reducing agent precursors that have no reducibility themselves but exhibit reducibility by the action of heat or a nucleophilic agent during the process of development can be used.

Examples of the reducing agent used in the present invention include reducing agents and reducing agent precursors described, for example, in U.S. Pat. No. 4,500,626, columns 49 to 50, U.S. Pat. No. 4,839,272, U.S. Pat. No. 4,330,617, U.S. Pat. No. 4,590,152, U.S. Pat. No. 5,017,454, U.S. Pat. No. 5,139,919, JP-A-60-140335, pages (17) to (18), JP-A-57-40245, JP-A-56-138736, JP-A-59-178458, JP-A-59-53831, JP-A-59-182449, JP-A-59-182450, JP-A-60-119555, JP-A-60-128436, JP-A-60-128439, JP-A-60-198540, JP-A-60-181742, JP-A-61-259253, JP-A-62-201434, JP-A-62-244044, JP-A-62-131253, JP-A-62-131256, JP-A-63-10151, JP-A-64-13546, pages (40) to (57), JP-A-1-120553, JP-A-2-32338, JP-A-2-35451, JP-A-2-234158, JP-A-3-160443, and EP-A-220 746, pages 78 to 96.

Combinations of various reducing agents as disclosed in U.S. Pat. No. 3,039,869 can also be used.

Examples of a developing agent that form color by coupling reaction with a coupler are p-phenylenediamines, p-aminophenols, and so on. More preferable examples are sulfonamidophenols described in JP-A-8-110608, JP-A-8-122994, JP-A-8-146578, JP-A-9-15806, and JP-A-9-146248; sulfonylhydrazines described in EP-A-545,491A, JP-A-8 -166664, and JP-A-8-227131; carbamoylhydrazines described in JP-A-8-286340; sulfonylhydrazones described in JP-A-8-202002, and carbamoylhydrazones described in JP-A-8-234390.

The color-developing agent may be used singly or in a combination of two or more kinds of the agents, and its total amount to be used is generally 0.05 to 20 millimoles/$m^2$, and preferably 0.1 to 10 millimoles/$m^2$.

In the light-sensitive material, couplers that form dyes by coupling reaction with the above-mentioned oxidized product of the above color-developing agent, are generally used. Preferable examples include compounds that are collectively referred to as active methylenes, 5-pyrazolones, pyrazoloazoles, phenols, naphthols, and pyrrolotriazoles. The specific examples described in RD No. 38957 (September 1996), on pages 616 to 624, may be used preferably. As particularly preferable examples, pyrazoloazole couplers, as described in JP-A-8-110608, and pyrrolotriazole couplers, as described in JP-A-8-122994 and JP-A-8-45564, can be mentioned. These couplers are generally used in an amount of 0.05 to 10 millimole/$m^2$ and preferably 0.1 to 5 millimole/$m^2$, for each color.

Furthermore, a colored coupler to rectify unnecessary absorption of color-forming dyes, and a compound (including coupler) that releases a photographically useful compound residue, for example, a development inhibitor, by a reaction with the oxidized product of the developing agent, can be used as well.

Further, as one mode of the present invention, the light-sensitive material can be configured such that it comprises, on a support, a non-light-sensitive layer and at least one layer of a light-sensitive silver halide emulsion layer, which comprises a light-sensitive silver halide emulsion, a coloring material that releases or diffuses a diffusible dye correspondingly or inversely-correspondingly to silver development, and a binder.

The coloring material used in this occasion is a compound containing a dye component in its structure itself, and having a capability to release or diffuse a diffusible dye correspondingly or inversely-correspondingly to silver development.

Part or all of the diffusible dyes is removed from the light-sensitive material, simultaneously or successively with the development. An image is obtained by a residual coloring material after development, in the light-sensitive material.

This compound can be represented by the following general formula [LI]:

$$((\mathrm{Dye})m-Y)n-Z \qquad [LI]$$

Dye represents a dye group, a dye group whose wavelength is temporarily shortened, or a dye precursor group, Y represents a single bond or a linking group, Z represents a group which has such a property that produces a difference in the diffusibility of the compound represented by ((Dye)m–Y)n–Z correspondingly or inversely-correspondingly to the light-sensitive silver salt having a latent image imagewise, or that releases (Dye)m–Y, to produce a difference in the diffusibility between (Dye)m–Y released and ((Dye)m–Y)n–Z, m is an integral number of 1 to 5, n is 1 or 2, and when both m and n is not 1, a plurality of Dyes are the same or different.

As specific examples of the dye-providing compound represented by the general formula [LI], compounds ① to ⑤ described in JP-A-9-121265 (p. 10–p. 21) can be mentioned. In this connection, the compounds ① to ③ are those that release or diffuse the diffusible dyes inversely-correspondingly to the development of silver halide, while the compounds ④ to ⑤ are those that release or diffuse the diffusible dye correspondingly to the development of silver halide. Further, as described in U.S. Pat. Nos. 4,362,806, 3,719,489, and 4,375,507, a compound that reacts with silver ion or organosilver ion complex to release a diffusible dye, can be used.

A light-sensitive material is usually comprising three or more types of phosensitive layers, each being different in color sensitivity. Each photosensitive layer contains at least one silver halide emulsion layer, and as a typical example, it comprises plural silver halide emulsion layers, whose color sensitivities are substantially identical but whose sensitivities are different. The photosensitive layer is a unit photosensitive layer having color sensitivity to any of blue light, green light, or red light. In a multilayer silver halide color photographic light-sensitive material, in general, the arrangement of the unit photosensitive layer is such that a red-sensitive layer, a green-sensitive layer, and a blue-sensitive layer in the order started from the support side are placed. However, depending on purposes, the above order can be reversed, and an order wherein a layer having a different color sensitivity is placed between light-sensitive layers having the same color sensitivity, can be used.

In the present invention, a yellow filter layer, a magenta filter layer, and an antihalation layer can be used as a colored layer using oil-soluble dyes, which can be decolored by development processing. If, for example, the light-sensitive layers are provided in the order of a red-sensitive layer, a green-sensitive layer, and a blue-sensitive layer, from the side nearest to the support, a yellow filter layer can be provided between the blue-sensitive layer and the green-sensitive layer, a magenta color filter layer can be provided between the green-sensitive layer and the red-sensitive layer, and a cyan color filter layer (antihalation layer) can be provided between the red-sensitive layer and the support. These colored layers may be arranged in a manner that they directly contact a light-sensitive layer (an emulsion layer), or in a manner they contact to a light-sensitive layer through an intermediate layer, such as gelatin. The amount of a dye to be used is a sufficient amount to make the transmission density of each layer be 0.03 to 3.0, more preferably 0.1 to 1.0, to blue light, green light, or red light, respectively. More concretely, the amount is, though it varies depending on the $\epsilon$ value and the molecular weight of the dye, generally in the range of 0.005 mmol/$m^2$ to 2.0 mmol/$m^2$, and more preferably 0.05 mmol/$m^2$ to 1.0 mmol/$m^2$.

Preferable examples of the dye to be used, as disclosed in JP-A-10-207027, include $(NC)_2C{=}C(CN){-}R_{16}$ ($R_{16}$ represents an aryl group or heterocyclic group), and a compound having a structure which comprises methine groups and two kinds of groups selected from: aryl groups (e.g. phenyl group and naphthyl group), and heterocyclic groups (e.g. pyrrole, indole, furan, thiophene, imidazole, pyrazole, indolizine, quinoline, carbazole, phenothiazine, phenoxazine, indoline, thiazole, pyridine, pyridazine, thiadiazine, pyran, thiopyran, oxadiazole, benzoquinoline, thiaziazole, pyrrolothiazole, pyrrolopyridazine, tetrazole, oxazole, coumarin, chroman); basic nulei (e.g. pyridine, quinoline, indolenine, oxazole, imidazole, thiazole, benzoxazole, benzoimidazole, benzothiazole, oxazoline, naphthooxazole or pyrrole); and acidic nuclei including compounds having a methylene group placed between electron-attracting groups (e.g. a methylene group placed between groups such as —CN, $-SO_2R_{14}$, $-COR_{14}$, $-COOR_{14}$, $-CON(R_{15})_2$, $-SO_2N(R_{15})_2$, $-C[{=}C(CN)_2]R_{14}$, and $-C[{=}C(CN)_2]N(R_{14})_2$ ($R_{14}$ each represents an alkyl group, an alkenyl group, an aryl group, a cycloalkyl group, and heterocyclic group, and $R_{15}$ represents a hydrogen atom or groups shown for $R_{14}$)) and cyclic ketomethylene compounds (e.g., 2-pyrazoline-5-one, 1,2,3,6-tetrahydropyridine-2,6-dione, rhodanine, hydantoin, thiohydantoin, 2,4-oxazolidinedione, isooxazolone, barbituric acid, thiobarbituric acid, indandione, dioxopyrazolopyridine, hydroxypyridine, pyrazolidinedione, 2,5-dihydrofuran-2-one and pyrroline-2-one).

Two or more kinds of dye may be used as a mixture in one colored layer of the light-sensitive member. For example, a mixture of three kinds of dye, including yellow, magenta, and cyan dye, can be added to the antihalation layer described above.

According to the present invention, preferably, a color-extinguishable-dye is used in the form of a dispersion, in which oil drops that include a color-extinguishable-dye dissolved in an oil and/or oil-soluble polymer, are dispersed in a hydrophilic binder. As a preparation method of the above, an emulsification and dispersion method is preferable, and the preparation can be conducted, for example, according to the method disclosed in U.S. Pat. No. 2,322,027. In this case, a high-boiling oil, as disclosed in U.S. Pat. Nos. 4,555,470, 4,536,466, 4,587,206, 4,555,476, and 4,599,296, JP-B-3-62,256, etc., can be used, if necessary, in combination with a low-boiling organic solvent having a boiling point of 50 to 160° C. Simultaneous use of two or more kinds of high-boiling oils is possible. An oil-soluble polymer can be used instead of the oil or in combination with the oil. An example is described in PCT WO88/00723.

The amount of the high-boiling oil and/or the polymer to be used is generally 0.01 to 10 g, preferably 0.1 to 5 g, per 1 g of the dye to be used.

The color of the dye disappears when developed in the presence of a color-extinguishing agent.

Examples of the color-extinguishing agents include alcohols or phenols, amines or anilins, sulfinic acids or salt thereof, sulfurous acids or salt thereof, thiosulfuric acids or salt thereof, carboxylic acids or salt thereof, hydrazines, guanidines, aminoguanidines, amidines, thiols, cyclic- or chain-like active methylene compounds, cyclic- or chain-like active methine compounds, and anions derived from these compounds.

Among the above, hydroxyamines, sulfinic acids, sulfurous acids, guanidines, aminoguanidines, heterocyclic thiols, cyclic- or chain-like active methylene compouns, or cylic- or chain-like active methine compounds are preferably used, and particularly preferably guanidines or aminoguanidines are used.

The above color-extinguishing agent extinguish a dye color by contacting the dye at development treatment, and then by being added nucleophilically to the dye molecule. Preferably, by overlaying the surface of film of a silver halide light-sensitive member containing the dye, at the time after image-wise exposure, or at the same time as image-wise exposure, with the surface of a processing member (first processing member described later) containing the color-extinguishing agent or color-extinguishing agent precurser, in the presence of water, heating those members, and then separating them, a colored image is obtained on the silver halide light-sensitive member, and the dye is extinguished, simultaneously. In this case, the density of the dye after extinction is generally one-third or below the original density, preferably one-fifth or below. The amount of the color-extinguishing agent is generally 0.1 to 200 times, more preferably 0.5 to 100 times, per mole of the dye.

The sum of the thickness of the light-sensitive layers is generally 1 to 20 $\mu$m, and preferably 3 to 15 $\mu$m.

The silver halide, the color-developing agent, and the coupler may be contained in the same or different light-sensitive layers. Moreover, in addition to the light-sensitive layer, non-light sensitive layers, such as a protective layer, a subbing layer, an intermediate layer, and the above-mentioned yellow filter layer and an antihalation layer, can be provided; and a backing layer may be provided on the rear side of the support. The thickness of all of the applied films on the side of the light-sensitive layer is generally 3 $\mu$m to 25 $\mu$m, preferably 5 $\mu$m to 20 $\mu$m.

Depending on various purposes, a hardening agent, a surfactant, a photographic stabilizer, an antistatic agent, a slipping agent, a matting agent, a latex, a formalin scavenger, a dye, and a UV absorbing agent may be used in the light-sensitive material. Specific examples of these are described in the above-mentioned RD, and in JP-A-9-204031, etc. Further, particularly preferable examples of the antistatic agent include fine particles of metal oxides, such as ZnO, $TiO_2$, $Al_2O_3$, $In_2O_3$, $SiO_2$, MgO, BaO, $MOO_3$, $V_2O_5$, and the like.

As a support for a light-sensitive material, supports for photography described in "Shasin Kogaku no Kiso—Ginen Shashin-hen", edited by Nihon Shashin-gakkai, pages 223–240, Corona, Co. (1979), are preferable. Specific examples include polyethylene terephthalate, polyethylene naphthalate, polycarbonate, syndiotactic polystyrene, celluloses (e.g. triacetylcellulose), and the like.

To improve optical characteristics and physical characteristics of these supports, heat treatment (for control of the degree of crystalinity and orientation), uniaxial and biaxial stretching (for control of orientation), blending of various types of polymers, surface treatment, or the like, may be performed.

Further, it is preferable to record photographing information by using a support that has a magnetic recording layer, as described in JP-A-4-124645, JP-A-5-40321, JP-A-6-35092, and JP-A-6-31875.

Preferably, a water-resistant polymer, as described in JP-A-8-292514, is applied on the rear side of the support of the light-sensitive material.

Details of a polyester support that is used particularly preferably in a light-sensitive material having the above magnetic recording layer, are described in Kokai Giho No. 94-6023 (Hatsumei-Kyokai; 1994.3.15).

The thickness of the support is generally 5 to 200 $\mu$m, and preferably 40 to 120 $\mu$m.

In the present invention, when the light-sensitive material through which shooting has been made is developed, a processing material other than the light-sensitive material can be used. The processing material contains at least a base and/or a base precursor. The most preferable ones thereof are systems described in EP-210 660 and U.S. Pat. No. 4,740,445 wherein a base is generated by means of a combination of a basic metal compound difficultly soluble in water with a compound that can undergo a complex formation reaction with the metal ion constituting the basic metal compound using water as a medium. In this case, although preferably the basic compound difficultly soluble in water is added to the light-sensitive material and the complex forming compound is added to the processing material, that can be reversed. A preferable combination of compounds is a system wherein fine particles of zinc hydroxide are used in the light-sensitive material and a salt of picolinic acid, such as guanidine picolinate, is used in the processing material.

A mordant may be used in the processing material, and in this case, a polymer mordant is preferable. As described in JP-A-8-179458, use can be made of a method wherein physical-development-nucleus such as colloidal silver and palladium sulfide, and a silver halide solvent such as hydantoin, may be contained in the processing material, and by solubilizing the silver halide in the light-sensitive material at the time of development to fix it on the processing material.

Additionally, the processing material may contain a development-stopping agent, a printout-preventing agent, or the like.

The processing material may comprise, in addition to the processing layer, auxiliary layers such as a protective layer, a subbing layer, a backing layer, and other layers.

As a form of the processing material to practise, a form wherein the processing layer is provided on a continuous web, and the processing material is fed from a feeding roll and is wound up by a separate roll without being cut even after having been used for the processing, is preferable. The example is described in Japanese Patent Application No. 8-222204.

A support of the processing material is not limited, and a plastic film or paper that are mentioned for light-sensitive materials, can be used. The thickness of the support is generally 4 $\mu$m to 120 $\mu$m, preferably 6 to 70 $\mu$m. A film to which aluminum is deposited, as described in Japanese Patent Application No. 8-52586, may be preferably used as well.

As a preferable method for developing the light-sensitive material for use in the present invention through which shooting has been made, a color-developing agent built-in-type heat-development system is preferable, and that is the objective method in view of rapid and easy processing with a low environmental load. Additionally, an image can be formed by processing the light-sensitive material of the present invention by an activator method using an alkaline processing solution, or by a processing method using a processing solution containing a color-developing agent/base.

The heating treatment of light-sensitive materials is known in the art, and the heat-developable light-sensitive materials and the process thereof are described, for example, in "Shashin Kogaku no Kiso" (published by Corona-sha, 1970), pages 55 to 555; "Eizo Joho" (published April 1978), page 40; "Nablettts Handbook of Photography and Reprography," 7th edition (van Nostrand and Reinhold Company), pages 32 to 33; U.S. Pat. No. 3,152,904, U.S. Pat. No. 3,301,678, U.S. Pat. No. 3,392,020, and U.S. Pat. No. 3,458,075, GB-1,131,108 and GB-25 1,167,777, and Research Disclosure (June 1978), pages 9 to 15 (RD-17029).

The activator treatment refers to a treatment wherein a color-developing agent is built in a light-sensitive material and the light-sensitive material is developed with a processing solution free from any color-developing agent. In this case, the processing solution is characterized in that it does not contain any color-developing agent, which is normally contained as a development processing solution component, but the processing solution may contain other components (e.g. an alkali and an auxiliary developing agent). Examples of the activator treatment are shown in known publications, such as European Patent Nos. 545,491A1 and 595,165A1.

The method wherein development is carried out using a processing solution containing a developing agent/base is described in RD. No. 17643, pages 28 to 29; RD. No. 18716, 651, left column to right column; and RD. No. 307105, pages 880 to 881.

Next, the processing materials and processing methods that are used in the case of heat-development, in the present invention, are hereinafter explained.

In the present invention, as a method for subjecting to development a light-sensitive material that has been used for photographing by means of a camera or the like, preferably a method, wherein the light-sensitive material and the processing material are put together with the light-sensitive layer and the processing layer facing each other, in the presence of water in an amount of 0.1 to 1 times the amount required for the maximum swelling of all the coating films of the light-sensitive material and the processing material, except the backing layers, and they are heated at a temperature of 60 to 100° C. for 5 to 60 sec, is used.

As a method for providing water, it can be mentioned a method wherein a light-sensitive material or a processing material are immersed in water, and then excessive water is removed using a squeeze roller. Furthermore, as described in JP-A-10-26817, a method for providing water, wherein water is jetted by water-applying equipment comprising a nozzle with multiple nozzle holes, to jet water, that are arranged linearly, at a certain interval, in the direction intersecting with the conveying direction of a light-sensitive material or a processing material, and an actuator that serves to dislocate the nozzle toward the light-sensitive material or the processing material being conveyed, is preferable. The application of water using a sponge or the like is also preferable.

As a method for heating at the developing steps, a method wherein making the material contact a block or a plate that is heated, or a method using a heat roller, a heat drum, an infrared lamp or a far infrared lamp, or the like can be used as well.

In the present invention, another bleach-fix step, to further remove developed silver and silver halide remaining in the light-sensitive material after processing, is not necessary. However, to reduce the load in reading image information, and to improve image preservability, a fixing step and/or bleaching step can be provided. In this case, a conventional liquid treatment can be used, but, it is preferable to conduct the treatment by a step wherein conducting heat treatment together with a separate sheet to which a processing agent is applied, as described in JP-A-9-258402.

In the present invention, when an image is formed based on non-diffusible dyes, on the light-sensitive material, by performing heat-development in the presence of a small amount of water, with using the light-sensitive material containing the coupler and the color-developing agent that exhibits extremely high stability in the absence of a base, and the processing material containing a base and/or base precursor, an image excellent in graininess and sharpness can be obtained; and if output is carried out based on the thus-obtained image information, onto different recording materials, such as color paper and a heat-development color print material, a very excellent color image can be obtained. Also, since the light-sensitive material is isolated from the base until the development, rapid development treatment is possible while satisfying high preservability that is required for materials for photographing.

Further, in contrast to use of a dye-providing compound, use of a colorless color-developing agent and a coupler is advantageous in the point of sensitivity, which is an extremely important factor as a material for photographing.

In the present invention, after the formation of a color-formed image by heat-development, the remaining silver halide and/or developed silver may or may not be removed. As a means for outputting to a different material based on its image information, the generally used projection exposure may be used, or the image information may be read photoelectrically by measuring the density of the transmitted light, and its signals may be outputted. The material to which the output is made may not be light-sensitive materials and may, for example, be sublimation-type thermographic (heat sensitive recording) materials, ink jet materials, electrophotographic materials, and full-color direct thermographic materials.

An example of a preferable mode in the present invention is one in which, after the formation of a color-formed image by heat-development, the image information is read photoelectrically by measuring the transmitted density, using a CCD image sensor and diffused light, and the information is transformed into digital signals that in turn are subjected to image processing and are outputted to a heat-development color printer, such as "PICTOGRAPHY 3000" (trade name), manufactured by Fuji Photo Film Co., Ltd. In this case, a good print can be obtained quickly without using any of the processing solutions used in conventional color photography. Further, in this case, since the above digital signals can be processed and edited arbitrarily, the photographed image can be corrected (retouched), modified, and processed freely, to be outputted.

As image-processing methods that can be preferably applied with using the light-sensitive material of the present invention, for example, following methods can be mentioned.

In JP-A-6-139323, an image-processing system and an image-processing method that can faithfully reproduce a color of the subject from a negative film, wherein an image of a subject is produced on a color-negative, and then it is converted to corresponding image data using a scanner or the like, and the same color as that of the subject is then outputted based on the demodulated color information, are mentioned, and they can be used in the present invention.

Further, as an image-processing method wherein graininess and noise of a digitized image are suppressed and sharpness is enhanced at the same time, a method to conduct weighting and fractionating treatment to the edge and noise of an image, based on sharpness enhanced image data, smoothed image data, and edge detected data, as described in Japanese Patent Application No. 9-62101; or a method to conduct weighting and fractionating treatment, with obtaining an edge component from sharpness enhanced image data and smoothed image data, as described in Japanese Patent Application No. 9-62102, can be used.

Further, to correct variations in color reproducibility in the final print, which are caused by differences, such as storage condition and processing condition of photographing materials, with a digital color print system, a method disclosed in Japanese Patent Application No. 9-59156 can be used, wherein a patch having four steps or four colors or more is exposed to light on an unexposed part of a photographic material, and, after development, the patch density is measured, to obtain a look-up table and a color conversion matrix required for correction, and thus colors of a photographic image are corrected by using look-up table conversion or performing matrix operations.

As a method for converting a color-reproduction range (gamut) of image data, use can be made of a method wherein, for an image data displayed by a color signal that is visually recognized to be a neutral color when values of each color component are made available, the color signal is divided into components of chromatic colors, and each of them is individually processed, as described in Japanese Patent Application No. 9-138853.

Furthermore, as a method for removing the deterioration of an image, such as aberration and lowering of brightness of the edge of the image field caused by a camera lens, use can be made of an image-processing method and apparatus that corrects digital image data, wherein a lattice-like correction pattern to create correction data for the image deterioration is preliminary recorded on a film, and then after photographing, both the image and the correction pattern are read out by the film scanner or the like, to create data to correct deterioration factors caused by the lens of a camera, and then by using the image-deterioration-correction data, digital image data is corrected, as described in Japanese Patent Application No. 9-228160.

Further, with respect to flesh color and sky-blue, if sharpness is excessively enhanced, graininess (noise) is enhanced simultaneously, and as a result, it causes an uncomfortable impression, and therefore, it is preferable to suppress the degree of enhancement of sharpness for flesh color and sky-blue. As means to attain that, use can be made of a method wherein, in the sharpness-enhancing processing using unsharp masking (USM), a USM coefficient is used as functions of (B−A) (R−A), as described in Japanese Patent Application No. 9-264086.

Further, flesh color, grass-green, and sky-blue are called "Important Colors" in color reproduction, for which selective color reproducing processing is required. Among these, with respect to the reproduction of lightness, it is said that finishing the flesh color to be light, and sky-blue to be deep, is visually preferable. As a method for reproducing these important colors so as to have visually preferable brightness, for example, a method is described in Japanese Patent Application No. 9-346588, wherein a color signal of each picture element is converted using a coefficient, such as (R−G) or (R−B), which takes a small value if a corresponding hue is yellow-red, and which takes a large value if the corresponding hue is cyan blue, and this method can be employed.

Furthermore, as a method for compressing a color signal, use can be made, for example, of a method described in Japanese Patent Application No. 9-270275, wherein the color signal of each picture element is separated into a lightness component and a chromaticity component, and, by selecting, for the chromaticity component, a template having the most suitable value patterns out of plural hue templates prepared in advance, hue information is encoded.

To prevent the occurrence of defects, such as color "blind", "attenuation" of highlight, and "flatness" in a high density area, and the occurrence of data that is out of a defined region, and at the same time, to conduct natural enhancing processing, at the time of treatment to increase saturation, sharpness, or the like, use can be made of an image-processing method and an image-processing apparatus described in Japanese Patent Application No. 9-338639, wherein each color density data of color image data is changed to exposure density data using a characteristic curve, and image processing, including color enhancement, is performed to thus-obtained data, and then they are further changed to density data using a characteristic curve.

The light-sensitive material of the present invention can be used as a material for photographing or printing. Preferably, it is used as a color negative film for photographing.

According to the silver halide light-sensitive material of the present invention, formation of an image with high sensitivity and low fogging can be achieved both in a simple and quick heat-development treatment and usual liquid developing treatment.

The present invention will be described in more detail with reference to the following examples, but the invention should not be construed as being limited thereto.

EXAMPLES

Example 1

<Preparation Method of Light-sensitive Silver Halide Emulsions>

(1) Preparation of Blue-light-sensitive AgBrI Tabular Grain Emulsion 1B-1

1000 cc of an aqueous solution, containing 1 g of gelatin having an average molecular weight of 15,000, and 0.9 g of KBr, were stirred, with the temperature kept at 40° C. To the solution, 17.4 cc of an aqueous solution (A), containing 0.69 g of $AgNO_3$, and 17.4 cc of an aqueous solution (B), containing 0.49 g of KBr, were added simultaneously, over 30 seconds, in a double jet manner. Then, 12 cc of a 10% aqueous solution of KBr was added to the resulting mixture, and the temperature was elevated to 75° C. over 27 minutes. After the temperature was raised to 75° C., 35 g of trimellitated gelatin was added to the mixture. Then, 3 cc of a 0.05% solution of compound (1) was added to the mixture, and then 115 cc of a 25% aqueous solution (C) of $AgNO_3$, and 94.2 cc of a 21.8% aqueous solution (D) of KBr, were simultaneously added, over 25 minutes, with the flow rate being accelerated (the flow rate at the end was three times that at the start), in a double jet manner. After that, 302 cc of an aqueous solution (E), containing 96.7 g of $AgNO_3$, and 285 cc of an aqueous solution (F), containing 73.5 g of KBr and 3.5 g of KI, were simultaneously added to the mixture, over 20 minutes, with the silver electric potential (to SCE) maintained at −40 mV, and with the flow rate being accelerated (the flow rate at the end was 5.1 times that at the start), in a double jet manner. Further, 97 cc of the (C) solution and the (D) solution were simultaneously added to the mixture, at a constant rate, for 3 minutes keeping the silver electric potential (to SCE) −40 mV, in a double jet manner. Then, 1.9 cc of 0.05% solution of sodium benzenthiosulfonate was added to the mixture.

Then, the temperature of the mixture was lowered to 40° C., and then an aqueous solution containing 19 g of compound (2), which is an iodide-ion-releasing agent, was added. To the mixture, 77 cc of a 0.8 M aqueous solution of sodium sulfite was added, at a constant rate, over 1 minute; the pH was raised to 9 and maintained, to produce iodide ion, and 2 minutes later, the temperature was raised to 55° C. spending 5 minutes, and then the pH was restored to 5.5. Then, after addition of $K_2IrCl_6$, at a rate of $4\times10^{-8}$ mol/mol-Ag to the total amount of silver in grains, 200 cc of a solution containing 12 g of de-ashed gelatin was added. To the mixture, 269 cc of an aqueous solution (G), containing 68 g of $AgNO_3$, and 220 cc of an aqueous solution (H), containing 57 g of KBr, were added simultaneously, at a constant rate, over 25 minutes.

Then, the resulting emulsion was cooled to 35° C., and, using a settling agent (1), the emulsion was washed with water by a conventional flocculation method. Then the pH was raised, 100 g of the gelatin was added, to disperse the emulsion, and then, pH and pAg were adjusted respectively to 5.5 and 8.2, to collect the resultant.

By adding compound (3) and water-soluble polymer (1), the pH was adjusted to 5.5, and the pAg was adjusted to 8.2.

The obtained emulsion was a hexagonal tabular grain emulsion, in which tabular grains occupied more than 99% of all the projected area of grains, and the tabular grains were those having an average diameter equivalent to a sphere of 0.86 μm, an average thickness of 0.12 μm, the average diameter equivalent to a circle of 1.75 μm, and an aspect ratio of 15. The iodide content was 5.5 mol %.

By adding a blue-sensitive sensitizing dye (1) ($9.5\times10^{-4}$ mol/mol-Ag), potassium thiocyanate, chloroaurate, sodium thiosulfate, and mono(pentafuluorophenyl)diphenyl phosphineselenide as a selenium sensitizer, at 60° C. and under conditions of pH 6.2 and pAg 8.4, spectral sensitization and chemical sensitization were conducted. To stop the chemical sensitization, compound (4) was used. The amount of the chemical sensitizer was adjusted so that 1/100-second exposure sensitivity of each emulsion became the maximum.

Compound (1)

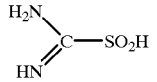

Compound (2)

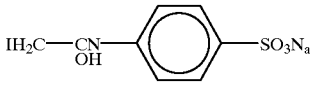

Settling agent (1)

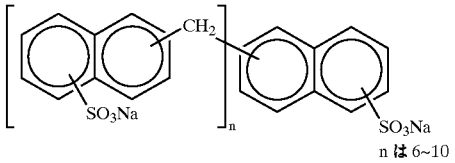

Compound (3)

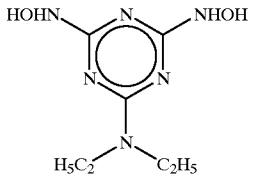

Water-soluble polymer (1)

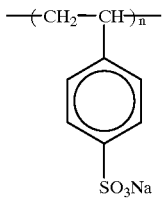

-continued

Blue-sensitive sensitizing dye (1)

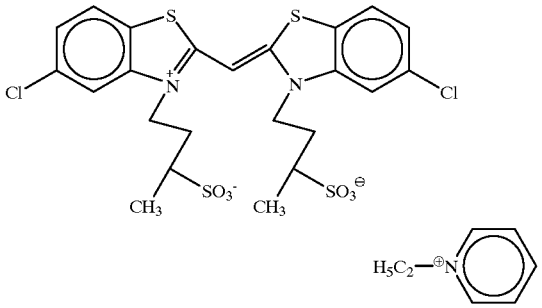

Compound (4)

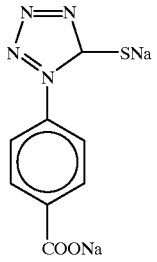

(2) Preparation and Evaluation of a Dispersion and a Coated Sample, and Preparation of a Dispersion of Zinc Hydroxide to be Used as a Base Precursor 31 g of zinc hydroxide powder, whose primary particles had a grain size of 0.1 μm, 1.6 g of carboxymethyl cellulose and 0.4 g of sodium polyacrylate, as a dispersant, 8.5 g of lime-processed ossein gelatin, and 158.5 ml of water were mixed together, and the mixture was dispersed by a mill containing glass beads for 1 hour. After the dispersion, the glass beads were filtered off, to obtain 188 g of a dispersion of zinc hydroxide.

Preparation of Emulsified Dispersion 1 Y of Yellow Coupler 10 g of a yellow coupler YC-1, 8.2 g and 1.6 g of respective developing agents (1) and (2), 21 g of high-boiling organic solvent (1), and 50.0 ml of ethyl acetate were dissolved at a temperature of 60° C. (II-liquid). The resulting solution was mixed with 170 g of an aqueous solution (I-liquid) comprising 12 g of lime-processed gelatin and 1 g of surfactant (1), and the mixture was emulsified and dispersed at 10,000 rpm for 20 minutes using a dissolver stirrer. After the dispersion, distilled water was added to bring the total weight to 300 g, and they were mixed at 2000 rpm for 10 minutes.

Yellow coupler
YC-(1)

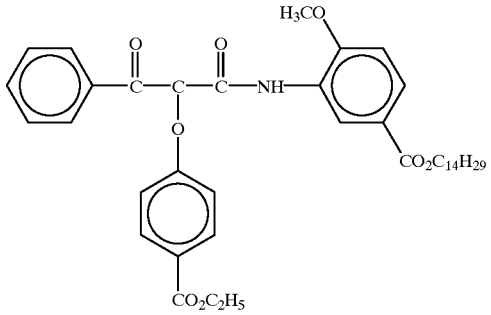

-continued

Developing agent-(1)

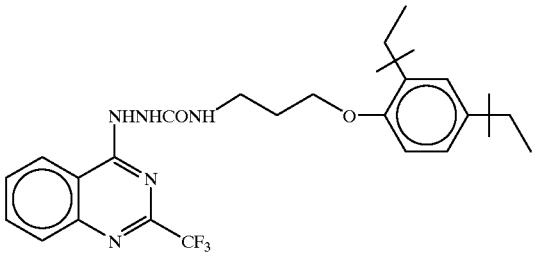

Developing agent-(2)

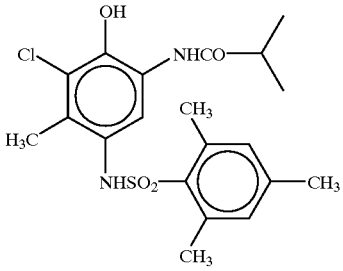

High-boiling organic solvent (1)

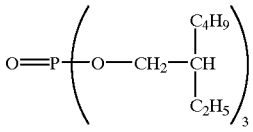

Surfactant (1)

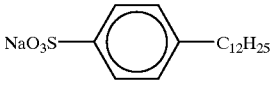

By adding N-3 to the emulsion 1B-1, and then adding an emulsified dispersion 1 Y, a light-sensitive emulsion coating solution was prepared. The solution was coated, together with the gelatin dispersion of zinc hydroxide, on a support with a composition shown in Table 1, to prepare Sample 101.

TABLE 1

Light-sensitive material 101

| Layer Composition | Added material | Added amount ($mg/m^2$) |
|---|---|---|
| Protective layer | Acid-processed gelatin | 1000 |
| | Matting agent (silica) | 50 |
| | Surfactant (2) | 100 |
| | Surfactant (3) | 300 |
| | Water-soluble polymer (1) | 15 |
| | Hardener (1) | 35 |
| Interlayer | Lime-processed gelatin | 950 |
| | Surfactant (3) | 15 |
| | Zinc hydroxide | 1100 |
| | Water-soluble polymer (1) | 15 |
| Yellow color-forming layer | Lime-processed gelatin | 800 |
| | Emulsion 1B-1 | 1931 (in terms of silver) |
| | Yellow coupler YC-(1) | 524 |
| | Developing agent (1) | 421 |
| | Developing agent (2) | 85 |
| | Surfactant (1) | 19 |
| | High-boiling organic solvent (1) | 1061 |
| | Water-soluble polymer (1) | 14 |
| Transparent PET base (120 μm), both sides of which is coated with a gelatin subbing layer | | |
| Antistatic layer | Lime-processed gelatin (molecular weight 12000) | 60 |
| | Fine grains of a composite of stannic oxide-antimony oxide having an average grain diameter of 0.005 μm (secondary aggregation grain diameter of about 0.08 μm at the specific resistance of $5\Omega \cdot cm^2$) | 180 |
| | Polyethylene-p-nonyiphenot (polymerization degree: 10) | 5 |
| Backing second layer | Lime-processed gelatin (molecular weight 12000) | 2000 |
| | Surfactant (3) | 11 |
| | PMMA latex (diameter: 6 μm) | 9 |
| | Hardener (2) | 455 |
| Backing third layer | Methyl methacrylate/styrene/2-ethythexyl acrytate/methacrylic acid copolymer | 1000 |
| | Surfactant (3) | 1.5 |
| | Surfactant (4) | 20 |
| | Surfactant (5) | 2.5 |

Surfactant (2)

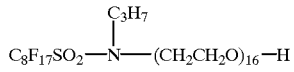

Surfactant (3)

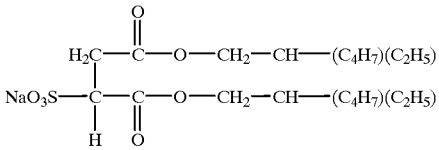

Surfactant (4)

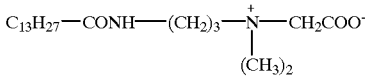

Surfactant (5)

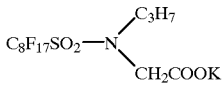

Hardener (1)

$(CH_2{=}CHSO_2)_2{-}CH_2$

Samples 101 to 114 were prepared by adding, to the emulsion 1B-1, a nitrogen-containing heterocyclic compound, in combination with zinc nitrate, as shown below.

In Samples 104 to 108, the nitrogen-containing heterocyclic compound and zinc nitrate were added to the light-sensitive emulsion coating solution. In Sample 103, N-18 was prepared in accordance with methods disclosed in the working example of U.S. Pat. No. 3,649,267 or JP-A-62-291642, and zinc ion was not added thereto. In Sample 109, N-3 was added to II-liquid, and zinc ion was added to I-liquid at the preparation of 1 Y. Sample 110 was prepared by using a mixture, which was obtained by adding an alkaline aqueous solution of N-3, to a 4% aqueous gelatin solution containing zinc ion that was well-stirred at 40° C., and then stirring for 10 minutes.

| | | Additives (mol) | |
|---|---|---|---|
| 101 | (Comparative example) | N-3 ($8 \times 10^{-3}$) | Blank |
| 102 | (Comparative example) | Blank | Blank |
| 103 | (Comparative example) | N-18 ($8 \times 10^{-3}$) | Zinc ion ($4 \times 10^{-3}$: exist in complex) |
| 104 | (Comparative example) | Blank | Zinc ion ($2 \times 10^{-2}$) |
| 105 | (Comparative example) | N-3 ($8 \times 10^{-3}$) | Zinc ion ($6 \times 10^{-3}$) |
| 106 | (This invention) | N-3 ($8 \times 10^{-3}$) | Zinc ion ($8 \times 10^{-3}$) |
| 107 | (This invention) | N-3 ($8 \times 10^{-3}$) | Zinc ion ($1 \times 10^{-2}$) |
| 108 | (This invention) | N-3 ($8 \times 10^{-3}$) | Zinc ion ($2 \times 10^{-2}$) |
| 109 | (This invention) | N-3 ($8 \times 10^{-3}$) | Zinc ion ($2 \times 10^{-2}$) |
| 110 | (This invention) | N-3 ($8 \times 10^{-3}$) | Zinc ion ($2 \times 10^{-2}$) |
| 111 | (Comparative example) | N-3 ($8 \times 10^{-3}$) | Calcium ion ($2 \times 10^{-2}$) |
| 112 | (Comparative example) | N-3 ($8 \times 10^{-3}$) | Cadmium ion ($2 \times 10^{-2}$) |
| 113 | (Comparative example) | Blank | Calcium ion ($2 \times 10^{-2}$) |
| 114 | (Comparative example) | Blank | Cadmium ion ($2 \times 10^{-2}$) |

These light-sensitive materials were exposed to light at 500 lux for 1/100 second, through an optical wedge, blue filter BPN42, manufactured by Fuji Photo Film Co., Ltd., and a 4800K color conversion filter.

Warm water at 40° C. was applied to each of the exposed light-sensitive materials, in an amount of 15 ml/m$^2$; the film surfaces of the light-sensitive material and the processing material P-1 were overlapped with each other, and they were heat-developed at 83° C. for 17 sec using a heat drum. Further, the film surfaces of the light-sensitive material and the processing material P-2 were overlapped with each other, and they were processed for 20 seconds at a temperature of 50° C. using a heat drum; and when they were peeled off, a yellow color wedge-like image was obtained.

The composition of the processing material P-1 is shown in Tables 2 and 3. The composition of the processing material P-2 is shown in Table 4.

TABLE 2

P-1

| Layer Composition | Added material | Added amount (mg/m$^2$) |
|---|---|---|
| Fourth layer | Lime-processed gelatin | 220 |
| Protective layer | Water-soluble polymer (2) | 60 |
| | Water-soluble polymer (3) | 200 |
| | Potassium nitrate | 12 |
| | PMMA latex (diameter: 6 μm) | 10 |
| | Surfactant (3) | 7 |
| | Surfactant (4) | 7 |
| | Surfactant (5) | 10 |
| Third layer | Lime-processed gelatin | 240 |
| Interlayer | Water-soluble polymer (2) | 24 |
| | Hardener (2) | 180 |
| | Surfactant (3) | 9 |
| Second layer | Lime-processed gelatin | 2400 |
| Base-producing | Water-soluble polymer (3) | 360 |
| | Water-soluble polymer (4) | 700 |

TABLE 2-continued

P-1

| Layer Composition | Added material | Added amount (mg/m$^2$) |
|---|---|---|
| layer | Water-soluble polymer (5) | 1000 |
| | Guanidine pocolinate | 2910 |
| | Potassium quinolinate | 225 |
| | Sodium quinolinate | 180 |
| | Surfactant (3) | 24 |
| First layer | Lime-processed gelatin | 280 |
| Interlayer | Water-soluble polymer (2) | 12 |
| Subbig layer | Surfactant (3) | 14 |
| | Hardener (2) | 185 |
| | Transparent base A (43 μm) | |

TABLE 3

Composition of Base A

| Name of layer | Composition | Added amount (mg/m$^2$) |
|---|---|---|
| Subbing layer of surface | Lime-processed gelatin | 100 |
| Polymer layer | Polyethylene terephthalate | 62500 |
| Subbing layer of back surface | Polymer (Methyl methacrylate/styrene/2-ethylhexyl acrylate/methacrylic acid copolymer) | 1000 |
| | PMMA latex | 120 |

TABLE 4

P-2

| Layer Composition | Added material | Added amount (mg/m$^2$) |
|---|---|---|
| Fourth layer | Lime-processed gelatin | 220 |
| Protective layer | Water-soluble polymer (2) | 60 |
| | Water-soluble polymer (3) | 200 |
| | Potassium nitrate | 12 |
| | PMMA latex (diameter: 6 μm) | 10 |
| | Surfactant (3) | 7 |
| | Surfactant (4) | 7 |
| | Surfactant (5) | 10 |
| Third layer | Lime-processed gelatin | 240 |
| Interlayer | Water-soluble polymer (2) | 24 |
| | Hardener (2) | 180 |
| | Surfactant (3) | 9 |
| Second layer | Lime-processed gelatin | 2400 |
| Fixing agent layer | Silver halide solvent (1) | 5500 |
| | Water-soluble polymer (5) | 2000 |
| | Surfactant (3) | 24 |
| First layer | Lime-processed gelatin | 280 |
| Interlayer | Water-soluble polymer (2) | 12 |
| Subbing layer | Surfactant (3) | 14 |
| | Hardener (2) | 185 |
| Transparent base A (43 μm) (the same base as to P-1) | | |

Water-soluble polymer (2)

κ—Carrageenan

Water-soluble polymer (3)

Sumika Gel L-5H (trade name, manufactured by Sumitomo Chemical Co., Ltd.)

Hardener (2)

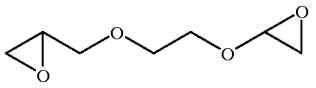

Water-soluble polymer (4)

Dextran (molecular weight of 70,000)

Water-soluble polymer (5)

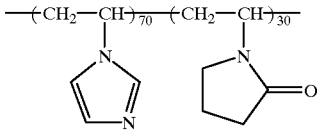

Silver halide solvent (1)

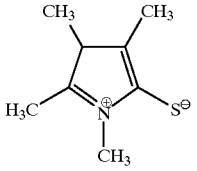

Further, for the above samples, the same exposure was conducted, and then they were processed using a conventional processing bath (processing bath CN-16 for color negative film (trade name)) containing a color-developing agent, at 38° C., for 165 seconds. The transmission density of each of the color-formed samples obtained by heat-development and color-development processing was measured using a blue filter, and a so-called "characteristic curve" was obtained. The relative sensitivity was determined as follows: the sensitivity was obtained from the reciprocal of the exposure amount giving a density that is 0.15 higher than the density of fog, and the sensitivity found was shown in terms of relative value by assuming the value of Sample 101 that was heat-developed to be 100. The results are shown in Table 5, together with Dmin.

From these results, it is understood that high sensitivity and a low Dmin were attained in both heat-development and the CN-16 processing, when the divalent metal cation for use in the present invention, which is an acid having intermediate hardness/softness in accordance with the HSAB principle, existed in amounts equimolar or more to the nitrogen-containing heterocyclic compound for use in the present invention. Further, to form complex of the divalent metal cation and the nitrogen-containing heterocyclic compound for use in the present invention was also preferable.

Example 2

Samples 201 to 216 were prepared in same manner as in Example 1, by combining the emulsion 1B-1 with the nitrogen-containing compound and the divalent metal cation as shown below. In Sample 205, N-42 was prepared according to the working example in U.S. Pat. No. 3,649,267 or JP-A-62-291642, and zinc ion was not added thereto. In Samples 205 to 209, the nitrogen-containing heterocyclic compound and zinc nitrate were added to the light-sensitive emulsion coating solution. Sample 210 was prepared using a mixture, which was obtained by adding an alkaline aqueous solution of N-25, to a 4% aqueous gelatin solution containing zinc ion that was well-stirred at 40° C., and then stirring for 10 minutes. Sample 211 was prepared by additionally adding nitrate ion to the light-sensitive emulsion coating solution of Sample 210. In Samples 212 to 213, the nitrogen-containing heterocyclic compounds and zinc nitrate were added to the light-sensitive emulsion coating solution. Sample 214 was prepared using a gelatin dispersion of zinc salt of N-25, which is prepared using equimolar amounts of zinc ion and N-25 that was prepared in Sample 210, and by adding N-3 and remaining zinc ion to the light-sensitive emulsion coating solution.

| | Additives (mol) |
|---|---|
| 201 (Comparative example) | Benzotriazole ($8 \times 10^{-3}$); Blank |
| 202 (Comparative example) | N-28 ($2 \times 10^{-3}$); Blank |

TABLE 5

| | Divalent cation/ nitrogen containing-heterocyclic compound | Heat-development | | CN-16 | |
|---|---|---|---|---|---|
| | (molar ratio) | Sensitivity | Dmin | Sensitivity | Dmin |
| 101 (Comparative example) | 0 | 100 | 0.3 | 56 | 0.15 |
| 102 (Comparative example) | — | — | 1.16 | 102 | 0.31 |
| 103 (Comparative example) | 0.5 | 98 | 0.32 | 60 | 0.12 |
| 104 (Comparative example) | — | — | 1.21 | 105 | 0.3 |
| 105 (Comparative example) | 0.75 | 99 | 0.31 | 81 | 0.13 |
| 106 (This invention) | 1 | 102 | 0.32 | 95 | 0.27 |
| 107 (This invention) | 1.25 | 102 | 0.29 | 97 | 0.26 |
| 108 (This invention) | 2.5 | 105 | 0.31 | 102 | 0.25 |
| 109 (This invention) | 2.5 | 102 | 0.29 | 105 | 0.26 |
| 110 (This invention) | 2.5 | 102 | 0.28 | 105 | 0.27 |
| 111 (Comparative example) | 2.5 | 100 | 0.32 | 50 | 0.11 |
| 112 (Comparative example) | 2.5 | 107 | 0.35 | 59 | 0.12 |
| 113 (Comparative example) | — | — | 1.37 | 100 | 0.31 |
| 114 (Comparative example) | — | — | 1.42 | 105 | 0.42 |

-continued

| | Additives (mol) |
|---|---|
| 203 (Comparative example) | N-25 ($2 \times 10^{-3}$); Blank |
| 204 (Comparative example) | Phenylmercaptotetrazole ($2 \times 10^{-3}$); Blank |
| 205 (Comparative example) | N-42 ($2 \times 10^{-3}$); Zinc ion ($10^{-3}$) (in complex) |
| 206 (Comparative example) | Benzotriazole ($8 \times 10^{-3}$); Zinc ion ($2 \times 10^{-2}$) |
| 207 (Comparative example) | Phenylmercaptotetrazole ($2 \times 10^{-3}$); Zinc ion ($2 \times 10^{-3}$) |
| 208 (This invention) | N-28 ($2 \times 10^{-3}$); Zinc ion ($2 \times 10^{-3}$) |
| 209 (This invention) | N-25 ($2 \times 10^{-3}$); Zinc ion ($2 \times 10^{-3}$) |
| 210 (This invention) | N-25 ($2 \times 10^{-3}$); Zinc ion ($2 \times 10^{-3}$) |
| 211 (This invention) | N-25 ($8 \times 10^{-3}$); Zinc ion ($2 \times 10^{-2}$) |
| 212 (This invention) | N-25 ($2 \times 10^{-3}$), N-3 ($8 \times 10^{-3}$); Zinc ion ($2 \times 10^{-2}$) |
| 213 (This invention) | N-28 ($2 \times 10^{-3}$), N-3 ($8 \times 10^{-3}$); Zinc ion ($2 \times 10^{-2}$) |
| 214 (This invention) | N-25 ($2 \times 10^{-3}$), N-3 ($8 \times 10^{-3}$); Zinc ion ($2 \times 10^{-2}$) |
| 215 (Comparative example) | N-25 ($2 \times 10^{-3}$), N-3 ($8 \times 10^{-3}$); Blank |
| 216 (Comparative example) | N-28 ($2 \times 10^{-3}$), N-3 ($8 \times 10^{-3}$); Blank |

These samples were exposed and developed in the same manner as in Example 1, then sensitivity and minimum color density (Dmin) were obtained, and the results are shown in Table 6. The sensitivity was represented in terms of relative value by assuming the value of Sample 101 that was heat-developed to be 100.

TABLE 6

| | Divalent cation/ nitrogen containing-heterocyclic compound | Heat-development | | CN-16 | |
|---|---|---|---|---|---|
| | (molar ratio) | Sensitivity | Dmin | Sensitivity | Dmin |
| 101 (Comparative example) | 0 | 100 | 0.3 | 56 | 0.15 |
| 201 (Comparative example) | 0 | 46 | 0.85 | 85 | 0.27 |
| 202 (Comparative example) | 0 | 52 | 0.72 | 42 | 0.16 |
| 203 (Comparative example) | 0 | 36 | 0.89 | 45 | 0.12 |
| 204 (Comparative example) | 0 | 31 | 0.86 | 65 | 0.22 |
| 205 (Comparative example) | 0.5 | 56 | 0.92 | 71 | 0.27 |
| 102 (Comparative example) | — | — | 1.16 | 102 | 0.31 |
| 104 (Comparative example) | — | — | 1.21 | 105 | 0.3 |
| 107 (This invention) | 2.5 | 105 | 0.31 | 102 | 0.25 |
| 206 (Comparative example) | 2.5 | 48 | 0.91 | 71 | 0.27 |
| 207 (Comparative example) | 1 | 42 | 0.97 | 74 | 0.23 |
| 208 (This invention) | 1 | 105 | 0.48 | 97 | 0.26 |
| 209 (This invention) | 1 | 103 | 0.51 | 100 | 0.31 |
| 210 (This invention) | 1 | 102 | 0.51 | 102 | 0.28 |
| 211 (This invention) | 2.5 | 102 | 0.5 | 105 | 0.27 |
| 212 (This invention) | 2 | 110 | 0.21 | 98 | 0.26 |
| 213 (This invention) | 2 | 112 | 0.23 | 101 | 0.27 |
| 214 (This invention) | 2 | 115 | 0.22 | 102 | 0.28 |
| 215 (Comparative example) | — | 115 | 0.22 | 43 | 0.19 |
| 216 (Comparative example) | — | 117 | 0.21 | 46 | 0.21 |

The results of Table 6 show that the use of the highly oil-soluble nitrogen-containing heterocyclic compound for use in the present invention give advantages. Further, the combination use of a phenylazole compound having a mercapto group and a benzotriazole compound is also preferable, in view of high sensitivity and of low Dmin.

Example 3

The method for preparing blue-light-sensitive {111} high-silver-chloride tabular grain emulsion 2B-1 is described.

1200 ml of a gelatin aqueous solution containing 2.1 g of deionized alkali-processed bone gelatin and 2 g of sodium chloride, was put into a reaction vessel and was maintained at 35° C. While the solution was strongly stirred, as the first step, to the solution, 60 ml of (A)-liquid, containing 7.2 g of silver nitrate, and 60 ml of (B)-liquid, containing 2.6 g of sodium chloride, were simultaneously added and mixed over one minute. One minute after the completion of addition, 40 ml of (C)-liquid, which is 80 ml of an aqueous solution containing 0.494 g of a crystal-habit-controlling agent (1), was added to the mixture, and, one minute later, 60 ml of a 10% aqueous solution of sodium chloride was added. After that, the mixture was heated to 75° C. spending 50 minutes, and, 10 minutes later, 450 ml of aqueous gelatin solution, containing 45 g of phthalated gelatin, was added, and 40 ml of the (C)-liquid was added to the mixture 3 minutes later. In addition, one minute later, 768 ml of (D)-liquid, which is an aqueous solution containing 113 g of silver nitrate, and 786 ml of (E)-liquid, which is an aqueous solution containing 31.5 g of sodium chloride and 20 g of potassium bromide, were added, simultaneously, at an initial rate of 2.85 ml/min, and at an accelerated rate of 0.818 ml/min$^2$. 5 minutes before the completion of addition of the (D)- and (E)-liquids, 30 ml of (F)-liquid, containing 0.43 g of sodium chloride, 0.015 g of yellow prussiate of potash, and 0.72 g of potassium iodide, was added, spending 5 minutes. Further, 4 minutes before the completion of the addition of the (D)- and (E)-liquids, 34 ml of a 10% aqueous solution of potassium bromide was added, in 3 seconds. 3 minutes after the completion of the addition of the (D)- and (E)-liquids, 159 cc of a 2 mM solution (water:methanol=1:1) of blue-sensitive sensitizing dye (2) was added and maintained for 10 minutes. The temperature of the mixture was lowered to 50° C., and desalting was carried out using a settling agent (2), in accordance with a conventional method. The dispersion was made by using 67 g of deionized alkali-processed bone gelatin, 30 cc of a 2% aqueous solution of $Zn(NO_3)_2.6H_2O$ (zinc nitrate) ($3\times10^{-3}$ mole per one mole of silver), compound (3), phenoxyethanol, and water-soluble polymer (1). The mixture was adjusted to pH 6.3, and pAg 7.7.

The obtained emulsion comprised {111} tabular grains of silver chlorobromide, having an average grain size represented by a diameter for a corresponding sphere of 0.93 μm, an average thickness of 0.12 μm, an average diameter equivalent to a circle of 2.1 μm, an average aspect ratio of 17, and a content of silver bromide of 29 mol %.

Chemical sensitization was carried out at a temperature of 60° C. by sequentially adding compound (5), 4-hydroxy-6-methyl-1,3,3a,7-tetraazaindene, sodium thiosulfate, mono (pentafluorophenyl)diphenylphosphine selenide, being a selenium sensitizer; chloroaurate, and sodium benzenethiosulfonate, to the emulsion, to achieve the maximum sensitivity. 15 minutes before the end of the chemical sensitization, 80 cc of a 2 mM (methanol:water=1:1) solution of blue-sensitive sensitizing dye (2) was added. Stopping of the chemical sensitization was done using compound (5).

Blue-sensitive sensitizing dye (2)

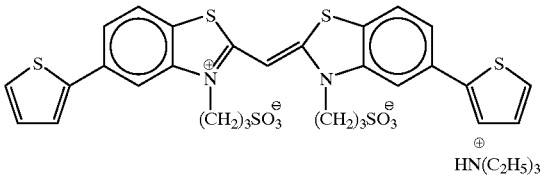

Crystal habit controlling agent (1)

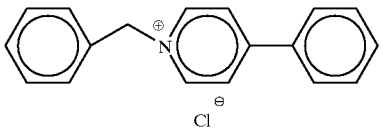

Settling agent (2)

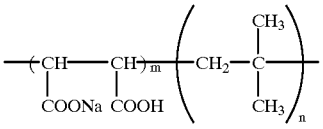

Compound (5)

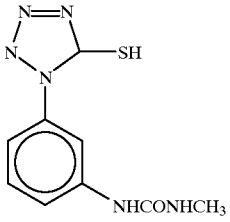

The light-sensitive material 301 was prepared in the same manner as the light-sensitive material 213, except that the emulsion 1B-1 was changed to 2B-1.

The exposure and development carried out for this material 301, in the same manner as in Example 1, and the material showed high sensitivity and low fogging in heat-development and CN-16 processing.

Example 4

Preparation of Red-light-sensitive AgBrI Tabular Grain Emulsion 4R-1

The AgBrI tabular grain emulsion 4R-1 was prepared in the same manner as for the AgBrI tabular grain emulsion 1B-1, except that compound (1) was not added, the aqueous solution (H) was changed to 220 cc of a liquid containing 48 g of KBr and 110 mg of yellow prussiate of potash; and then, 90 cc of 10% solution of KBr was added; zinc nitrate was added, at $1\times10^{-3}$ mol/mol-Ag for the total silver amount of grains, at the time of gelatin dispersion, and the sensitizing dye was changed to the same molar quantity of red-light-sensitizing dyes, with the ratio of the red-light-sensitive sensitizing dyes (1), (2), and (3) being 61:2:33 (molar ratio). The obtained emulsion was a hexagonal tabular grain emulsion, in which tabular grains occupied more than 99% of all projected area of all grains, and the tabular grains had an average diameter corresponding to a sphere of 0.86 μm, an average thickness of 0.12 μm, an average diameter equivalent to a circle of 1.75 μm, and an average aspect ratio of 15. The content of iodide was 5.5 mol %.

Red-sensitive sensitizing dye (1)

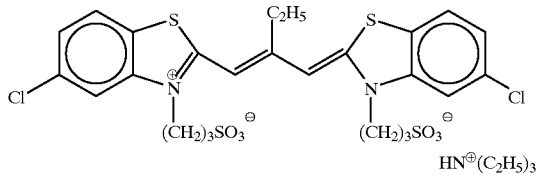

Red-sensitive sensitizing dye (2)

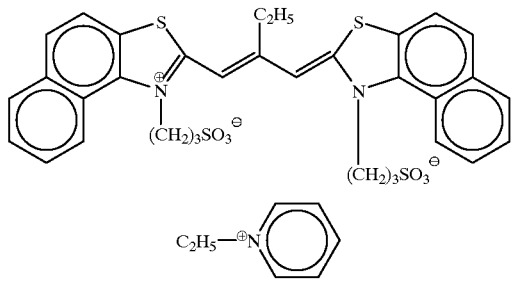

Red-sensitive sensitizing dye (3)

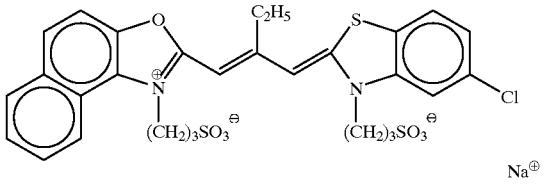

Preparation of Emulsified Dispersion 4Cy of Cyan Coupler 10.7 g of a cyan coupler CC-(1), 8.2 g and 1.05 g of respective developing agents (3) and (2), 11 g of high-boiling organic solvent (1), and 24.0 ml of ethyl acetate were dissolved at a temperature of 60° C. 8 g of high-boiling organic solvent (1) and 50.0 ml of ethyl acetate were dissolved at 60° C. (II-liquid). The resulting solution was mixed with 170 g of an aqueous solution (I-liquid) comprising 12 g of lime-processed gelatin and 1 g of surfactant (1), and the mixture was emulsified and dispersed at 10,000 rpm for 20 minutes using a dissolver stirrer. After the dispersion, distilled water was added to bring the total weight to 300 g, and they were mixed at 2000 rpm for 10 minutes.

Cyan coupler

CC-(1)

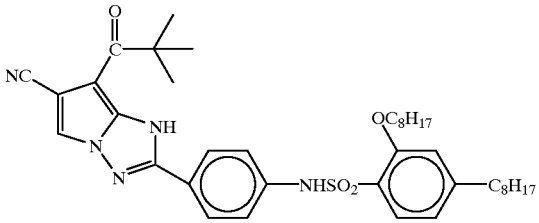

Developing agent-(3)

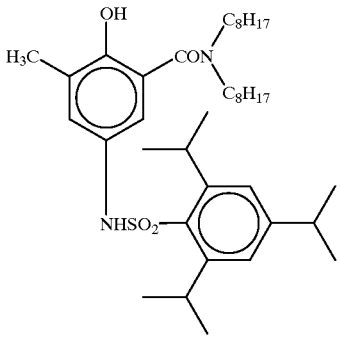

Samples 401 to 403, which are single-layer color photographic materials, were prepared in the same manner and the same composition as Sample 101, except that the above emulsion 4R-1 and the above cyan coupler emulsified dispersion 4 Cy were used in place of emulsion 1B-1 and yellow coupler emulsified dispersion 1 Y, with the combination of the nitrogen-containing heterocyclic compound and zinc ion as shown below, together with gelatin solution containing zinc hydroxide.

| | Additives (mol) |
|---|---|
| 401 (Comparative example) | N-3 ($3 \times 10^{-3}$), N-25 ($10^{-3}$); Zinc ion ($10^{-3}$) |
| 402 (Comparative example) | Blank; Zinc ion ($1 \times 10^{-2}$) |
| 403 (This invention) | N-3 ($3 \times 10^{-3}$), N-25 ($10^{-3}$); Zinc ion ($1 \times 10^{-2}$) |

The zinc ion used in Sample 401 means the zinc ion added when the emulsion was dispersed into the gelatin.

For Samples 401 to 403, exposure to light, development processing, and measurement of sensitivity and minimum color density (Dmin) were conducted in the same manner as in Example 1, except that the BPN42 optical filter used at the time of exposure was changed to a red filter SC60, manufactured by Fuji Photo Film Co., Ltd., and the transmission density in the color-developed samples were measured with the red filter. The results are shown in Table 7. The sensitivity was represented by a relative value with the value obtained by heat-development of sample 401 assumed to be 100.

TABLE 7

| | Divalent cation/ nitrogen containing-heterocyclic compound | Heat-development | | CN-16 | |
|---|---|---|---|---|---|
| | (molar ratio) | Sensitivity | Dmin | Sensitivity | Dmin |
| 401 (Comparative example) | 0.25 | 100 | 0.32 | 56 | 0.15 |
| 402 (Comparative example) | — | 78 | 0.79 | 100 | 0.32 |
| 403 (This invention) | 2.5 | 102 | 0.33 | 105 | 0.18 |

Example 5

Preparation of Green-light-sensitive AgBrI Tabular Grain Emulsion 5G-1

The AgBrI tabular grain emulsion 5G-1 was prepared in the same manner as for the AgBrI tabular grain emulsion 4R-1, except that the sensitizing dyes were changed to the same molar quantity of the green-light-sensitizing dyes, with the ratio of the green-light-sensitive sensitizing dyes (1), (2), and (3) being 70:20:10 (molar ratio). The obtained emulsion was a hexagonal tabular grain emulsion, in which tabular grains occupied more than 99% of all projected area of all grains, and the tabular grains had an average diameter corresponding-to a sphere of 0.86 μm, an average thickness of 0.12 μm, an average diameter equivalent to a circle of 1.75 μm, and an average aspect ratio of 15. The content of iodide was 5.5 mol %.

Green-sensitive sensitizing dye (1)

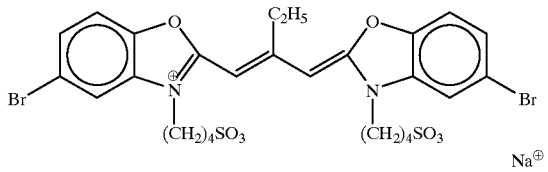

Green-sensitive sensitizing dye (2)

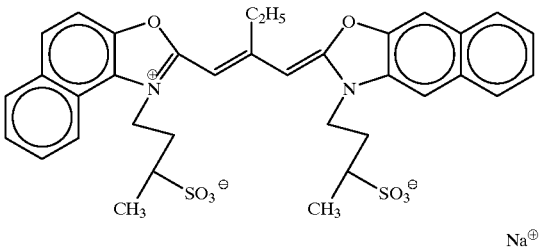

Green-sensitive sensitizing dye (3)

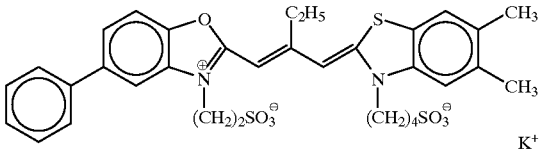

Preparation of Emulsified Dispersion 5M of Magenta Coupler 7.5 g and 1 g of magenta couplers MC-(1) and MC-(2) respectively, 8.2 g and 1.05 g of respective developing agents (3) and (2), 11 g of high-boiling organic solvent (1), and 24.0 ml of ethyl acetate were dissolved at a temperature of 60° C. 8 g of high-boiling organic solvent (1) and 50.0 ml of ethyl acetate were dissolved at 60° C. (II-liquid). The resulting solution was mixed with 170 g of an aqueous solution (I-liquid) comprising 12 g of lime-processed gelatin and 1 g of surfactant (1), and the mixture was emulsified and dispersed at 10,000 rpm for 20 minutes using a dissolver stirrer. After the dispersion, distilled water was added to bring the total weight to 300 g, and they were mixed at 2000 rpm for 10 minutes.

Magenta coupler

MC-(1)

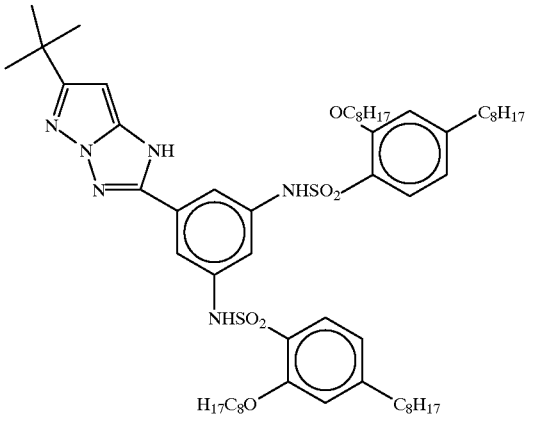

-continued

MC-(2)

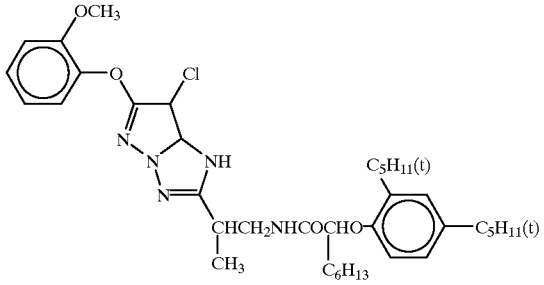

Samples 501 to 503, which are single layer color photographic materials, were prepared in the same manner and the same composition as Sample 101, except that the above emulsion 5G-1 and the above magenta coupler emulsified dispersion 5M were used in place of emulsion 1B-1 and yellow coupler emulsified dispersion 1 Y, with the combination of the nitrogen-containing heterocyclic compound and zinc ion as shown below, together with gelatin solution containing zinc hydroxide.

| | Additives (mol) |
|---|---|
| 501 (Comparative example) | N-3 ($1 \times 10^{-3}$), N-25 ($10^{-3}$); Zinc ion ($10^{-3}$) |
| 502 (Comparative example) | Blank; Zinc ion ($2 \times 10^{-2}$) |
| 503 (This invention) | N-3 ($1 \times 10^{-3}$), N-25 ($10^{-3}$); Zinc ion ($5 \times 10^{-3}$) |

The zinc ion used in Sample 501 means the zinc ion added when the emulsion was dispersed into the gelatin.

For the samples, exposure to light, development processing, and measurement of sensitivity and minimum color density (Dmin) were conducted in the same manner as in Example 1, except that the BPN42 optical filter used at the time of exposure was changed to a red filter SC50, manufactured by Fuji Photo Film Co., Ltd., and the transmission density in the color-developed samples were measured with the green filter. The results are shown in Table 8. The sensitivity was represented by a relative value with the value obtained by heat-development of sample 501 assumed to be 100.

TABLE 8

| | Divalent cation/ nitrogen containing-heterocyclic compound | Heat-development | | CN-16 | |
|---|---|---|---|---|---|
| | (molar ratio) | Sensitivity | Dmin | Sensitivity | Dmin |
| 501 (Comparative example) | 0.5 | 100 | 0.25 | 41 | 0.11 |
| 502 (Comparative example) | — | 65 | 0.86 | 97 | 0.22 |
| 503 (This invention) | 2.5 | 102 | 0.24 | 100 | 0.19 |

Example 6

By methods shown below, a multilayer full-color photographic light-sensitive material was prepared. Preparation of green-light-sensitive AgBrI tabular grain emulsion 6G-1.

The emulsion 4-B in Example 6 of JP-A-10-1612263 or in Example 6 of EP-A-0845706A2 was used as an emulsion 6G-1. The obtained emulsion was a hexagonal tabular grain emulsion, in which tabular grains occupied more than 99% of all projected area of all grains, and the tabular grains had an average diameter corresponding to a sphere of 0.66 μm, an average thickness of 0.095 μm, an average diameter equivalent to a circle of 1.4 μm, and an average aspect ratio of 14.5.

Preparation of Green-light-sensitive AgBrI Tabular Grain Emulsion 6G-2

The emulsion 4-D in Example 6 of JP-A-10-1612263 or in Example 6 of EP-A-0845706A2 was used as an emulsion 6G-2. The obtained emulsion was a hexagonal tabular grain emulsion, in which tabular grains occupied more than 99% of all projected area of all grains, and the tabular grains had an average diameter corresponding to a sphere of 0.37 μm, an average thickness of 0.1 μm, an average diameter equivalent to a circle of 0.58 μm, and an average aspect ratio of 5.8.

Preparation of Red-light-sensitive AgBrI Tabular Grain Emulsion 6R-1

The AgBrI tabular grain emulsion 6R-1 was prepared in the same manner as in the green-light-sensitive AgBrI tabular grain emulsion 6G-1, except that the sensitizing dye was changed to the same molar quantity of red-light-sensitizing dyes, with the ratio of the red-light-sensitive sensitizing dyes (1), (2), and (3) being 58:2:40 (molar ratio).

Preparation of Red-light-sensitive AgBrI Tabular Grain Emulsion 6R-2

The AgBrI tabular grain emulsion 6R-2 was prepared in the same manner as in the green-light-sensitive AgBrI tabular grain emulsion 6G-2, except that the sensitizing dye was changed to the same molar quantity of red-light-sensitizing dyes, with the ratio of the red-light-sensitive sensitizing dyes (1), (2), and (3) being 58:2:40 (molar ratio).

Preparation of Blue-light-sensitive AgBrI Tabular Grain Emulsion 6B-1

The AgBrI tabular grain emulsion 6B-1 was prepared in the same manner as in the green-light-sensitive AgBrI tabular grain emulsion 6G-1, except that the sensitizing dye was changed to the same molar quantity of blue-light-sensitizing dye (1).

Preparation of Blue-light-sensitive AgBrI Tabular Grain Emulsion 6B-2

The AgBrI tabular grain emulsion 6B-2 was prepared in the same manner as in the green-light-sensitive AgBrI tabular grain emulsion 6G-2, except that the sensitizing dye was changed to the same molar quantity of blue-light-sensitizing dye (1).

To each emulsion was added zinc nitrate, at $1\times10^{-3}$ mole per one mole of silver for the total silver amount of grains.

<Preparation of Dye Compositions for Yellow Filter, Magenta Filter, and Antihalation Layer>

The yellow filter dye was prepared as an emulsified dispersion in the following manner.

14 g of YF-1 and 13 g of a high-boiling organic solvent (2) were weighed, and ethyl acetate was added thereto, and the mixture was heated to about 60° C. and dissolved, to make a uniform solution. To 100 cc of this solution, 1.0 g of a surface active agent (1), and 190 cc of a 6.6% aqueous solution of lime-processed gelatin heated to about 60° C., were added, and the mixture was dispersed by a homogenizer for 10 minutes at 10,000 rpm.

The magenta filter dye was prepared as an emulsified dispersion in the following manner.

13 g of MF-1 and 13 g of a high-boiling organic solvent (2) were weighed, and ethyl acetate was added thereto, and the mixture was heated to about 60° C. and dissolved, to make a uniform solution. To 100 cc of this solution, 1.0 g of a surface active agent (1) and 190 cc of 6.6% aqueous solution of lime-processed gelatin heated to about 60° C. were added, and the mixture was dispersed by a homogenizer for 10 minutes at 10,000 rpm.

The cyan filter dye for antihalation layer was prepared as an emulsified dispersion in the following manner.

20 g of CF-1 and 15 g of a high-boiling organic solvent (2) were weighed, and ethyl acetate was added thereto, and the mixture was heated to about 60° C. and dissolved, to make a uniform solution. To 100 cc of this solution, 1.0 g of a surface active agent (1) and 190 cc of 6.6% aqueous solution of lime-processed gelatin heated to about 60° C. were added, and the mixture was dispersed by a homogenizer for 10 minutes at 10,000 rpm.

YF-1

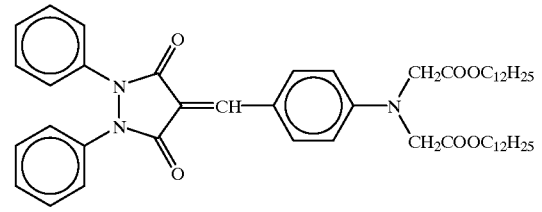

-continued

MF-1

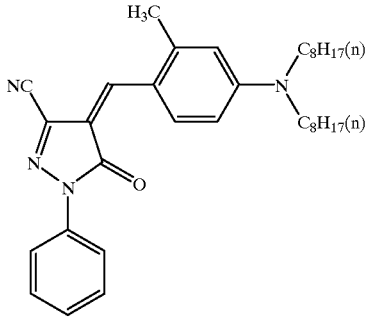

CF-1

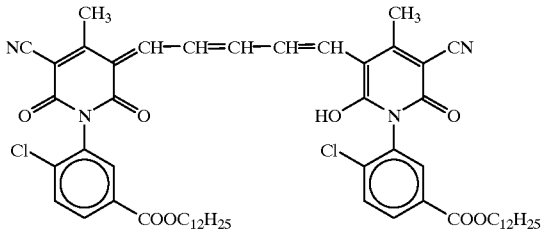

High-boiling organic solvent (2)

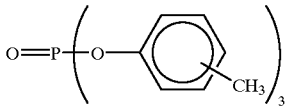

<Preparation of Support>

The same support as in Example of 6 of JP-A-10-161263 or Example 6 of EP-0845706A2 was used.

A multilayer light-sensitive material 602 according to the present invention was prepared, by using the blue-light-sensitive emulsions 1B-1, 6B-1, and 4B-2, and yellow coupler gelatin dispersion 1 Y, for a blue light-sensitive layer; the green-light-sensitive emulsions 5G-1, 6G-1, and 6G-2, and the magenta coupler gelatin dispersion 5M, for a green light-sensitive layer; the red light-sensitive emulsions 4R-1, 6R-1, and 6R-2, and cyan coupler gelatin dispersion 4 Cy, for a red light-sensitive layer; three kinds of dye dispersions, the zinc hydroxide dispersion, and a support. The nitrogen-containing heterocyclic compound N-3 was added to the coupler emulsified dispersion. The nitrogen-containing heterocyclic compound N-25 was added as the gelatin dispersion of the complex with zinc ion, which was prepared in Sample 210 in Example 2. The remaining zinc ion was additionally added when the coating solution was prepared.

A light-sensitive material 602, as a comparative example, was prepared in the same manner as for the light-sensitive material 601, except that N-25 was added in the form of a methanol solution, and zinc ion of the coating solution was not added thereto.

TABLE 9

Light-sensitive material 601

| Layer Composition | Added material | Added amount (mg/m$^2$) | Added amount ($\mu$mol/m$^2$) |
|---|---|---|---|
| Protective layer | Acid-processed gelatin | 1000 | |
| | Matting agent (silica) | 100 | |
| | Surfactant (5) | 100 | |
| | Surfactant (3) | 300 | |
| | Water-soluble polymer (1) | 20 | |
| Interlayer | Lime-processed gelatin | 500 | |
| | Surfactant (3) | 15 | |
| | Zinc hydroxide | 340 | |
| | Water-soluble polymer (1) | 30 | |
| Yellow color-forming layer (high-sensitivity layer) | Lime-processed gelatin | 1184 | |
| | Emulsion 1B-1 | 500 (in terms of silver) | 4634 |
| | Nitrogen-containing compound N-3 | 8.4 | 32 |
| | Nitrogen-containing compound N-25 | 1.6 | 5.3 |
| | Zinc hydroxide · $6H_2O$ | 19.3 | 65 |
| | Yellow coupler YC-(1) | 228 | |
| | Developing agent (1) | 185 | |
| | Developing agent (2) | 38 | |
| | Surfactant (1) | 26 | |
| | High-boiling Organic solvent (1) | 466 | |
| | Water-soluble polymer (1) | 15 | |
| Yellow color-forming layer (low-sensitivity layer) | Lime-processed gelatin | 1725 | |
| | Emulsion 6B-1 | 320 | 2966 |
| | Emulsion 6B-2 | 180 (in terms of silver) | 1668 |
| | Nitrogen-containing compound N-3 | 15.7 | 60 |
| | Nitrogen-containing compound N-25 | 3.926 | 13 |
| | Zinc hydroxide · $6H_2O$ | 74.25 | 250 |
| | Yellow coupler YC-(1) | 357 | |
| | Developing agent (1) | 290 | |
| | Developing agent (2) | 59 | |
| | Surfactant (1) | 42 | |

TABLE 9-continued

| Light-sensitive material 601 | | | |
|---|---|---|---|
| Layer | | Added amount | |
| Composition | Added material | (mg/m$^2$) | ($\mu$mol/m$^2$) |
| | High-boiling organic solvent (1) | 731 | |
| | Water-soluble polymer (1) | 43 | |
| Interlayer | Lime-processed gelatin | 210 | |
| Yellow filter | Yellow dye YF-1 | 140 | |
| | High-boiling organic solvent (2) | 130 | |
| | Hardener (1) | 130 | |
| Magenta | Lime-processed gelatin | 496 | |
| color- | Emulsion 5G-1 | 721 | 6682 |
| forming | | (in terms of silver) | |
| layer (high- | Nitrogen-containing compound N-3 | 1.1 | 4.2 |
| sensitivity | Nitrogen-containing compound N-25 | 1.87 | 6.2 |
| layer) | Zinc hydroxide · $6H_2O$ | 5.64 | 19 |
| | Magenta coupler MC-(1) | 62 | |
| | Magenta coupler MC-(2) | 8 | |
| | Developing agent (3) | 68 | |
| | Developing agent (2) | 8.7 | |
| | Surfactant (1) | 6.5 | |
| | High-boiling organic solvent (1) | 66 | |
| | Water-soluble polymer (1) | 15 | |
| Magenta | Lime-processed gelatin | 551 | |
| color-forming | Emulsion 6G-1 | 346 | 3207 |
| layer | | (in terms of silver) | |
| (medium- | Nitrogen-containing compound N-3 | 1.5 | 5.8 |
| sensitivity | Nitrogen-containing compound N-25 | 1.54 | 5.1 |
| layer) | Zinc hydroxide · $6H_2O$ | 5.05 | 17 |
| | Magenta coupler MC-(1) | 100 | |
| | Magenta coupler MC-(2) | 15 | |
| | Developing agent (3) | 109 | |
| | Developing agent (2) | 14 | |
| | Surfactant (1) | 11 | |
| | High-boiling organic solvent (1) | 107 | |
| | Water-soluble polymer (1) | 3 | |
| Magenta | Lime-processed gelatin | 665 | |
| color-forming | Emulsion 6G-2 | 300 | 2780 |
| layer (low- | | (in terms of silver) | |
| sensitivity | Nitrogen-containing compound N-3 | 3.7 | 14 |
| layer) | Nitrogen-containing compound N-25 | 1.27 | 4.2 |
| | Zinc hydroxide · $6H_2O$ | 5.05 | 17 |
| | Magenta coupler MC-(1) | 274 | |
| | Magenta coupler MC-(2) | 36.5 | |
| | Developing agent (3) | 300 | |
| | Developing agent (2) | 38.5 | |
| | Surfactant (1) | 28 | |
| | High-boiling organic solvent (1) | 292 | |
| | Water-soluble polymer (1) | 5 | |
| Interlayer | Lime-processed gelatin | 1150 | |
| Magenta | Magenta dye MF-1 | 100 | |
| filter | High-boiling organic solvent (2) | 100 | |
| | Zinc hydroxide | 2030 | |
| Cyan color- | Lime-processed gelatin | 1000 | |
| forming | Emulsion 4R-1 | 996 | 9231 |
| layer (high- | | (in terms of silver) | |
| sensitivity | Nitrogen-containing compound N-3 | 0.78 | 3 |
| layer) | Nitrogen-containing compound N-25 | 0.85 | 2.8 |
| | Zinc hydroxide · $6H_2O$ | 5.64 | 19 |
| | Cyan coupler CC-1 | 189 | |
| | Developing agent (3) | 145 | |
| | Developing agent (2) | 18.5 | |
| | Surfactant (1) | 15 | |
| | High-boiling organic solvent (1) | 141 | |
| | Water-soluble polymer (1) | 3 | |
| Cyan color- | Lime-processed gelatin | 292 | |
| forming layer | Emulsion 6R-1 | 391 | 3624 |
| (medium- | | (in terms of silver) | |
| sensitivity | Nitrogen-containing compound N-3 | 2.04 | 7.8 |
| layer) | Nitrogen-containing compound N-25 | 0.59 | 1.95 |
| | Zinc hydroxide · $6H_2O$ | 5.05 | 17 |
| | Cyan coupler CC-1 | 90 | |
| | Developing agent (3) | 69 | |
| | Developing agent (2) | 8.8 | |
| | Surfactant (1) | 7 | |
| | High-boiling organic solvent (1) | 67.3 | |
| | Water-soluble polymer (1) | 5 | |

TABLE 9-continued

| Light-sensitive material 601 | | | |
|---|---|---|---|
| Layer | | Added amount | |
| Composition | Added material | (mg/m$^2$) | ($\mu$mol/m$^2$) |
| Cyan color-forming layer (low-sensitivity layer) | Lime-processed gelatin | 730 | |
| | Emulsion 6R-2 | 321 (in terms of silver) | 2975 |
| | Nitrogen-containing compound N-3 | 3.34 | 12.8 |
| | Nitrogen-containing compound N-25 | 0.76 | 2.5 |
| | Zinc hydroxide · $6H_2O$ | 8.02 | 27 |
| | Cyan coupler CC-1 | 232 | |
| | Developing agent (1) | 178 | |
| | Developing agent (2) | 23 | |
| | Surfactant (1) | 17 | |
| | High-boiling organic solvent (1) | 173 | |
| | Water-soluble polymer (1) | 8 | |
| Interlayer | Lime-processed gelatin | 240 | |
| Antihalation | Cyan dye CF-1 | 200 | |
| | High-boiling organic solvent (2) | 150 | |
| | Subbing layer | | |
| | PEN base (92 $\mu$m) | | |
| | Subbing Layer | | |
| | Antistatic layer | | |
| | Magnetic recording layer | | |
| | Slipping layer | | |

Total amount of nitrogen-containing heterocyclic compound 180.65 $\mu$mol/m$^2$
Total amount of zinc ion 431 $\mu$mol/m$^2$
(those included in base emulsion) 33 $\mu$mol/m$^2$
Zinc ion/nitrogen-containing heterocyclic compound 2.38

Exposure of the light-sensitive material was carried out in the same manner as in Example 1, except that the BPN42 filter used at the time of the exposure was removed. Warm water at 40° C. was applied to each of the exposed light-sensitive materials, in an amount of 20 ml/m$^2$; the film surfaces of the light-sensitive material and the processing material P-4 were overlapped with each other; they were heat-developed at 87° C. for 20 sec using a heat drum. Further, the film surfaces of the light-sensitive material and the processing material P-2 were overlapped with each other, and they were processed for 20 seconds at a temperature of 50° C. using a heat drum. The processing material P-4 was prepared in the same manner as for P-1, except that the amount of guanidine picolinate was changed to 4500 mg/m$^2$.

With respect to an image on the thus-processed light-sensitive material, the transmission densities of wedge-like image with yellow, magenta, and cyan colors were respectively measured by using a blue, green, and red filter, to obtain characteristic curve, and the sensitivity and minimum color density Dmin were obtained. The results are shown in Table 10. Each of the blue, green, and red sensitivity was represented by a relative value by assuming the value obtained by heat-development of sample 601 as being 100.

TABLE 10

| | $Zn^{2+}$/nitrogen containing-heterocyclic compound | | Heat-development | | CN-16 | |
|---|---|---|---|---|---|---|
| | (molar ratio) | | Sensitivity | Dmin | Sensitivity | Dmin |
| 601 (This invention) | 2.38 | B | 100 | 0.98 | 102 | 0.70 |
| | | G | 100 | 0.60 | 97 | 1.21 |
| | | R | 100 | 0.50 | 95 | 1.10 |
| 602 (Comparative example) | 0.18 | B | 98 | 0.97 | 65 | 0.72 |
| | | G | 101 | 0.56 | 63 | 1.16 |
| | | R | 102 | 0.51 | 58 | 1.06 |

From these results, it is understood that, even with the multilayer light-sensitive material, high sensitivity and low Dmin were attained in both heat-development and the CN-16 processing, when the divalent metal cation for use in the present invention, which is an acid having intermediate hardness/softness in accordance with the HSAB principle, existed in amounts equimolar or more to the nitrogen-containing heterocyclic compound for use in the present invention.

Samples were prepared by putting the multi-coated sample 601 into cartridges, and the samples were loaded on a camera, and a photographing test was carried out. The thus-photographed films were processed by one of two kinds of processing methods, heat-development or CN-16 processing; and in both cases, excellent images were obtained. When the images were captured by Frontier (trade name), manufactured by Fuji Photo Film Co., Ltd., and then the images were outputted by PICTROGRAPHY 3000 (trade name), excellent hard copies were obtained as well.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide photographic light-sensitive material, which contains, in a silver halide emulsion layer on a support, at least one nitrogen-containing heterocyclic compound represented by one of general formula (1), (2), (3), (4) or (5), a divalent metal cation that is an acid with intermediate hardness/softness classified in accordance with the HSAB principle, in an amount 1 to 300 times the number of moles of the nitrogen-containing heterocyclic compound, and an anion acting as a counter ion, the anion being selected from the group consisting of a nitrate ion, a sulfate ion, a chloride ion, a bromide ion, an iodide ion, a carbonate ion, a sulfite ion, a bicarbonate ion, a bisulfite ion, an ammonium ion, an acetate ion and a phosphate ion, wherein the nitrogen-containing heterocyclic compound and the divalent metal cation are included in the same silver halide emulsion layer:

General formula (1)

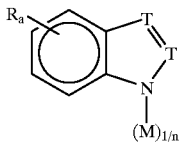

General formula (2)

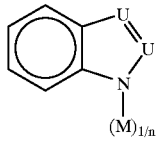

General formula (3)

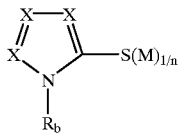

General formula (4)

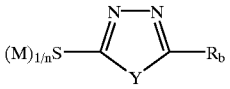

General formula (5)

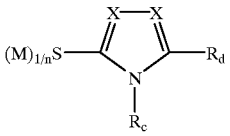

wherein $R_a$, $R_b$, $R_c$, and $R_d$ each independently represent an alkyl group, a cycloalkyl group, an alkenyl group, an alkynyl group, an aralkyl group, an aryl group, a heterocyclic group, an alkoxy group, an aryloxy group, an amino group, an acylamino group, a ureido group, a urethane group, a sulfonamide group, a sulfamoyl group, a carbamoyl group, a sulfonyl group, an oxycarbonyl group, an acyl group, an acyloxy group, an alkylthio group or an arylthio group, in which the number of carbon atoms of the $R_a$ is 4 or more but 16 or less, the total number of carbon atoms of the $R_b$ is 10 or more, and the sum of carbon atoms of $R_c$ and $R_d$ is 12 or more; each of T represent a nitrogen atom, C—H or C—SH; each of U represent a nitrogen atom, C—H, C—SH or C—$R_a$, and at least one of them is C—$R_a$; each of X represent a nitrogen atom or C—H; Y represents an oxygen atom, a sulfur atom, or N—H; M, if it is univalent, represents a hydrogen atom, an alkali metal atom, a quaternary ammonium group, or a quaternary phosphonium group, with n being 1; M, if it is divalent, represents an alkaline earth metal atom, a cadmium, or an atom being a divalent metal cation having intermediate hardness/softness in accordance with the HSAB principle, with n being 2; M, if it is trivalent, represents a boron, an aluminum, or an iron, with n being 3; in general formulae (1) and (2), the benzene ring may have a substituent.

2. The silver halide photographic light-sensitive material as claimed in claim 1, which has, on a support, a photosensitive layer comprising a silver halide emulsion that contains silver halide tabular grains with a thickness of 0.2 $\mu$m or less.

3. The silver halide photographic light-sensitive material as claimed in claim 1, which has, on a support, a photosensitive layer comprising a silver halide emulsion that contains silver halide in which silver chloride content is 50 mol % or more.

4. The silver halide photographic light-sensitive material as claimed in claim 1, wherein the divalent metal cation is a zinc ion, a copper ion, a nickel ion, or a lead ion.

5. The silver halide photographic light-sensitive material as claimed in claim 4, wherein the divalent metal cation is a zinc ion.

6. The silver halide photographic light-sensitive material as claimed in claim 1, which contains a developing agent represented by any one of general formulae (6) to (9)

General formula (6)

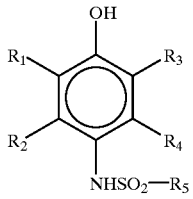

General formula (7)

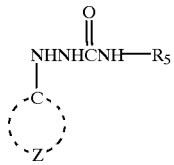

General formula (8)

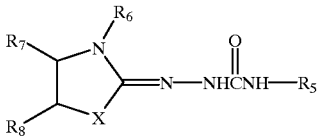

General formula (9)

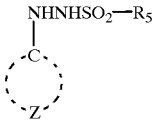

wherein $R_1$, $R_2$, $R_3$, and $R_4$ each independently represent a hydrogen atom, a halogen atom, an alkyl group, a cycloalkyl group, an aryl group, an alkylcarbonamide group, an arylcarbonamide group, an alkylsulfonamide group, an arylsulfonamide group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, or an acyloxy group; $R_5$ represents an alkyl group, an aryl group, or a heterocyclic group; Z represents a group of atoms forming a (hetero)aromatic ring, if z is a benzene ring, the sum of Hammett's constant ($\sigma$) of its substituents is 1 or more; $R_6$ represents an alkyl group; X represents an oxygen atom, a sulfur atom, a selenium atom, or an alkyl- or aryl-substituted tertiary nitrogen atom; $R_7$ and $R_8$ represent a hydrogen atom or a substituent, or $R_7$ and $R_8$ may bond together to form a double bond or a ring; and at least one ballasting group having 8 or more carbon atoms is contained in each of general formulae (6) to (9), in order to impart oil-solubility to the molecule thereof.

7. The silver halide photographic light-sensitive material as claimed in claim 1, wherein an image can be formed by:

a development by heat, wherein water, whose amount corresponds to from 1/10 of to 1-fold times the volume of water required for the maximum swelling of an entire coated film of the light-sensitive material, is made to lie between the light-sensitive material and a processing material that contains a base and/or a base precursor, and these materials are processed with overlapping each other, or a development using a processing bath containing a developing agent that is an aromatic primary amine.

8. The silver halide photographic light-sensitive material as claimed in claim 1, wherein the amount of the divalent metal cation to be added is 1.5 to 200 times the number of moles of the nitrogen-containing heterocyclic compound.

9. The silver halide photographic light-sensitive material as claimed in claim 1, wherein the amount of the divalent metal cation to be added is $3\times10^{-3}$ to 1 mol per mol of silver.

10. The silver halide photographic light-sensitive material as claimed in claim 1, wherein the amount of the divalent metal cation to be added is 30% or less of the total amount of gelatin in the same layer.

11. The silver halide photographic light-sensitive material as claimed in claim 1, wherein the amount of the compound represented by any one of formulae (1) to (5) to be added is $10^{-5}$ to 1 mole per mole of the silver halide, when the compound is added to a silver halide emulsion layer.

12. The silver halide photographic light-sensitive material as claimed in claim 1, which contains, as the compound, a compound represented by general formula (1) or (2) having no mercapto group, and a compound selected from a compound represented by general formula (1) or (2) having a mercapto group or a compound represented by any one of general formulae (3) to (5).

* * * * *